US010391796B2

(12) United States Patent
Ito et al.

(10) Patent No.: US 10,391,796 B2
(45) Date of Patent: Aug. 27, 2019

(54) RECORDING APPARATUS

(71) Applicant: SEIKO EPSON CORPORATION, Tokyo (JP)

(72) Inventors: Tatsuya Ito, Shiojiri (JP); Kazuhisa Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/030,711

(22) Filed: Jul. 9, 2018

(65) Prior Publication Data

US 2019/0016163 A1 Jan. 17, 2019

(30) Foreign Application Priority Data

Jul. 12, 2017 (JP) ..... 2017-136023

(51) Int. Cl.
*B41J 3/60* (2006.01)
*B41J 11/00* (2006.01)
*B41J 23/02* (2006.01)

(52) U.S. Cl.
CPC ..... *B41J 23/02* (2013.01); *B41J 3/60* (2013.01); *B41J 11/0045* (2013.01)

(58) Field of Classification Search
CPC ..... B41J 11/0045; B41J 3/60; B41J 3/4071; B41J 13/103; B41J 13/0063
USPC ..... 347/101, 104, 153
See application file for complete search history.

(56) References Cited

U.S. PATENT DOCUMENTS 6,871,946 B2 * 3/2005 Yanagi ..... B41J 13/103 101/35
6,871,949 B2 * 3/2005 Nakano ..... B41J 3/4071 347/104
8,465,019 B2 * 6/2013 Komuro ..... B41J 3/4071 271/213
2007/0222846 A1 9/2007 Nakamura et al.
2008/0074458 A1 3/2008 Niioka et al.
2016/0236489 A1 8/2016 Nakano et al.

FOREIGN PATENT DOCUMENTS

JP 2009-029144 A 2/2009
JP 4304530 B 5/2009
JP 2013-166623 A 8/2013
JP 2016-150826 A 8/2016
JP 2016-217368 A 12/2016
JP 2017-001834 A 1/2017

* cited by examiner

*Primary Examiner* — An H Do
(74) *Attorney, Agent, or Firm* — Workman Nydegger

(57) ABSTRACT

There is provided a recording apparatus including: a recording unit that performs recording on a medium transported in a first direction; a medium feeding unit that is positioned in a second direction opposite to the first direction of the recording unit, includes a medium supporting unit; and a medium reversing unit that reverses the medium transmitted in the second direction after the recording of the recording unit, and transmits the medium to the first direction, in which the medium feeding unit includes a first guide unit and forms a first guide surface in the downward slope toward the first direction, and a power transmission unit that transmits a driving power from a power source of the medium reversing unit to the medium reversing unit, and at least a part of the first guide unit in a vertical direction overlaps with the power transmission unit.

10 Claims, 22 Drawing Sheets

RECORDING APPARATUS

BACKGROUND

1. Technical Field

The present invention relates to a recording apparatus which performs recording on a medium.

2. Related Art

A recording apparatus represented by a facsimile machine, a printer, or the like is provided with a rear feeding device to which a recording sheet as a medium can be set in a rear tilted posture. The rear feeding device includes a feeding roller and a hopper which supports the recording sheet and can switch between a state in which a feeding roller presses the supported recording sheet and a state in which the feeding roller is separated from the recording sheet.

JP-A-2016-150826 and JP-A-2016-217368 are examples of the recording apparatus of the related art.

In addition, the recording apparatus in JP-A-2016-150826 and JP-A-2016-217368 includes a reverse path for reversing the sheet on which recording is performed so as to record on both sides of the sheet.

In a configuration including both of the reverse path and the rear feeding device, there is a case where the rear feeding device is disposed on an upper side of the reverse path (roller for reversing sheet) in the same manner as JP-A-2016-150826 and JP-A-2016-217368. In this case, a height dimension of the apparatus increases.

SUMMARY

An advantage of some aspects of the invention is to provide a recording apparatus including a rear feeding device and a reverse path and to further miniaturize the apparatus.

According to an aspect of the invention, there is provided a recording apparatus including: a recording unit that performs recording on a medium transported in a first direction; a medium feeding unit that is positioned in a second direction opposite to the first direction of the recording unit, includes a medium supporting unit which forms a downward slope toward the first direction, and transmits the supported medium to a side of the first direction; and a medium reversing unit that is positioned in the second direction of the medium supporting unit, reverses the medium transmitted in the second direction after the recording of the recording unit, and transmits the medium to the side of the first direction, in which the medium feeding unit includes a first guide unit that is positioned on a downstream side of the medium supporting unit and forms a first guide surface in the downward slope toward the first direction, and a power transmission unit that transmits a driving power from a power source of the medium reversing unit to the medium reversing unit, and at least a part of the first guide unit in a vertical direction overlaps with the power transmission unit.

In this configuration, since at least a part of the first guide unit included in the medium feeding unit overlaps with the power transmission unit in the vertical direction, the medium feeding unit is disposed at a position lowered to the same height position as at least a part of the power transmission unit in the vertical direction. Therefore, by disposing the medium feeding unit at a lower position in the vertical direction, it is possible to suppress a dimension in an apparatus height direction and to further miniaturize the apparatus.

In the recording apparatus, it is preferable that the power transmission unit be disposed in a space formed on the side of the second direction of the medium supporting unit.

In this configuration, since the power transmission unit is disposed in the space formed on the side of the second direction of the medium supporting unit, that is, the power transmission unit is disposed by using the space formed on the side of the second direction of the medium supporting unit, it is possible to suppress the dimension of the apparatus in the apparatus depth direction and the dimension of the apparatus in a medium width direction which intersects with a medium feeding direction.

In the recording apparatus, it is preferable that the apparatus include a second guide unit which forms a second guide surface in the downward slope in the first direction and positioned on an upper side of the first guide surface, and at least a part of the first guide unit in the vertical direction overlap with the second guide unit.

In this configuration, since at least a part of the first guide unit overlaps with the second guide unit in the vertical direction, the medium feeding unit is disposed at a position lowered to the same height position as at least a part of the second guide unit in the vertical direction, it is possible to suppress the dimension in the apparatus height direction and to further miniaturize the apparatus.

In the recording apparatus, it is preferable that the apparatus include a second guide unit which forms a second guide surface in the downward slope in the first direction and positioned on an upper side of the first guide surface, and at least a part of the first guide unit in an apparatus depth direction including the first direction and the second direction overlap with the second guide unit.

In this configuration, since at least a part of the first guide unit overlaps with the second guide unit in the apparatus depth direction, it is possible to suppress the dimension in the apparatus depth direction and to further miniaturize the apparatus.

In the recording apparatus, it is preferable that the first guide unit be positioned between the second guide unit and the medium reversing unit in an apparatus depth direction including the first direction and the second direction, and a space for drawing the first guide unit toward the second direction in the diagonally upward direction be formed between the second guide unit and the medium reversing unit and the medium feeding unit be detachable from the apparatus main body.

In this configuration, since the space for drawing the first guide unit toward the second direction in the diagonally upward direction is formed between the second guide unit and the medium reversing unit and the medium feeding unit is detachably provided with the apparatus main body, it is possible to easily attach or detach the medium feeding unit to or from the apparatus main body with improved workability.

In the recording apparatus, it is preferable that the power transmission unit include a plurality of gears, and the plurality of gears be disposed along a drawing direction of the first guide unit.

In this configuration, since the power transmission unit includes the plurality of gears and the plurality of gears are arranged along the drawing direction of the first guide unit, it is possible to suppress the dimension in the apparatus depth direction and to further miniaturize the apparatus.

According to another aspect of the invention, there is provided a recording apparatus including: a recording unit that performs recording on a medium transported in a first direction; a medium feeding unit that is positioned in a second direction opposite to the first direction of the recording unit, includes a medium supporting unit which forms in a downward slope toward the first direction, and transmits the supported medium to a side of the first direction; and a medium reversing unit that is positioned in the second direction of the medium supporting unit, reverses the medium transmitted in the second direction after the recording of the recording unit, and transmits the medium to the side of the first direction, in which the medium feeding unit includes a first guide unit that is positioned on a downstream side of the medium supporting unit and forms a first guide surface in the downward slope toward the first direction, an apparatus main body including the recording unit and the medium reversing unit includes a second guide unit which forms the downward slope in the first direction and forms the second guide surface positioned on an upper side of the first guide surface, and the first guide unit is positioned between the medium reversing unit and the second guide unit in an apparatus depth direction including the first direction and the second direction and at least a part of the first guide unit in a vertical direction overlaps with the second guide unit.

In this configuration, since at least a part of the first guide unit overlaps with the second guide unit in the vertical direction, the medium feeding unit is disposed at a position lowered to the same height position as at least a part of the second guide unit in the vertical direction. Therefore, by disposing the medium feeding unit at a lower position in the vertical direction, it is possible to suppress the dimension in the apparatus height direction and to further miniaturize the apparatus.

In the recording apparatus, it is preferable that at least a part of the first guide unit in the apparatus depth direction overlap with the second guide unit.

In this configuration, since at least a part of the first guide unit overlaps with the second guide unit in the apparatus depth direction, it is possible to suppress the dimension in the apparatus depth direction and to further miniaturize the apparatus.

In the recording apparatus, it is preferable that a space for drawing the first guide unit toward the second direction in the diagonally upward direction be formed between the second guide unit and the medium reversing unit and the medium feeding unit be detachably provided with the apparatus main body.

In this configuration, since the space for drawing the first guide unit toward the second direction in the diagonally upward direction is formed between the second guide unit and the medium reversing unit and the medium feeding unit is detachably provided with the apparatus main body, it is possible to easily attach or detach the medium feeding unit to or from the apparatus main body with improved workability.

In the recording apparatus, it is preferable that the medium feeding unit be fixed to the apparatus main body by a fastening member accessible in a vertical direction.

In this configuration, since the medium feeding unit is fixed to the apparatus main body by the fastening member accessible from the vertical direction, it is possible to easily fix or release the medium feeding unit to or from the apparatus main body with improved workability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
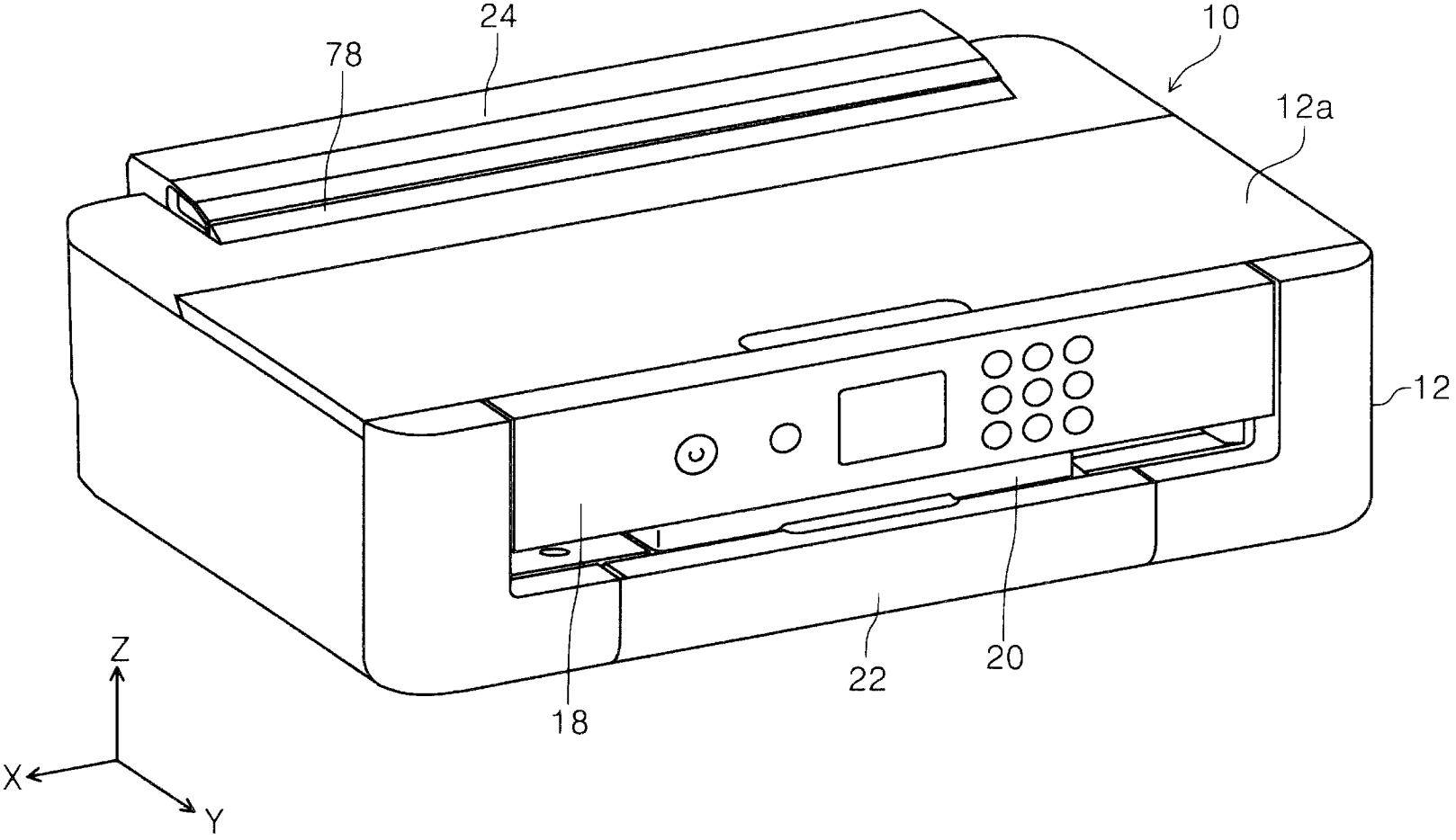
FIG. 1 is an external perspective view of a printer according to the invention.

Hereinafter, embodiments of the invention will be described based on drawings. In each of the embodiments, the same components are denoted by the same reference numerals, a configuration of only the first embodiment will be described, and descriptions of configurations of the following embodiments will be omitted.

Figure 2:
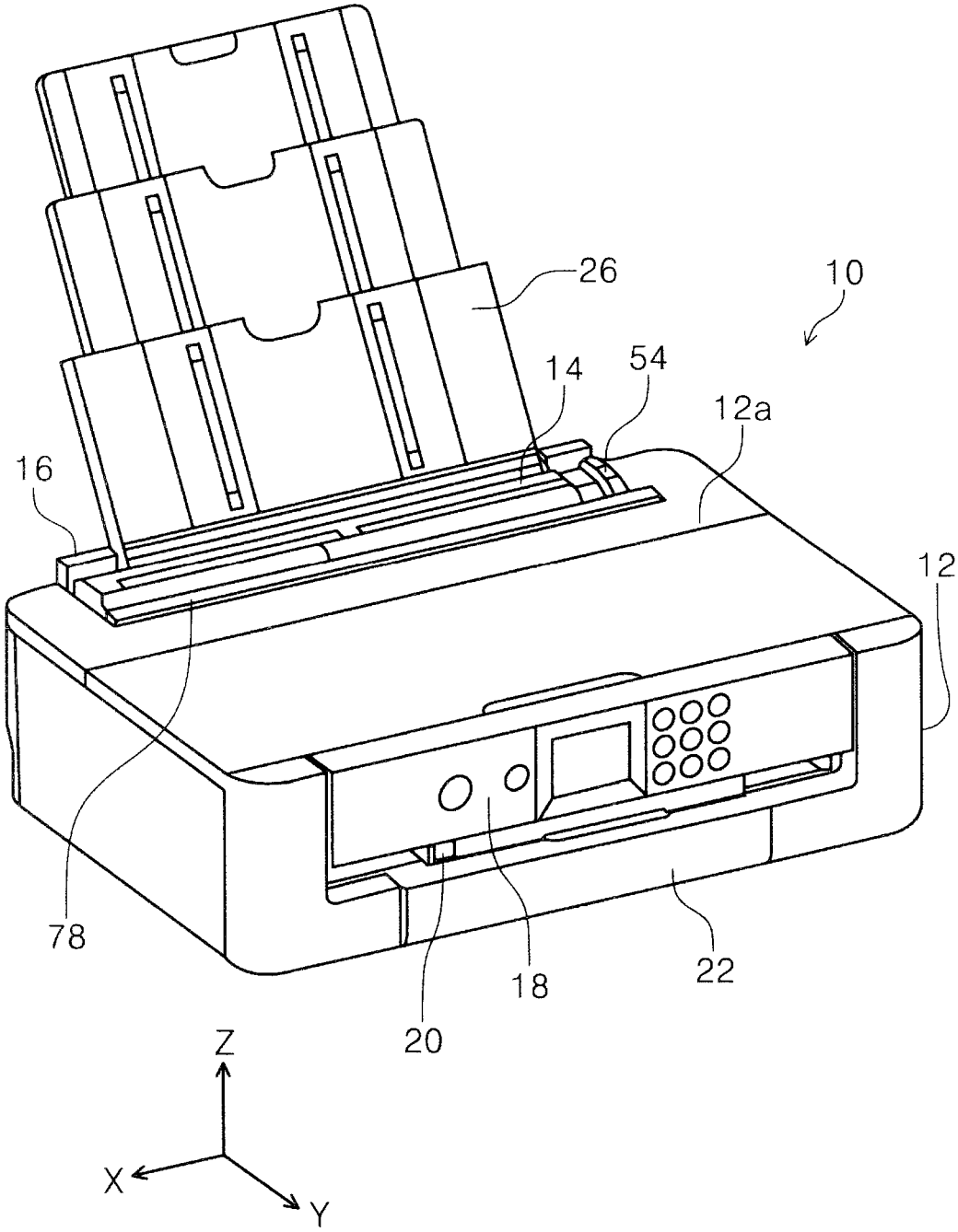
FIG. 2 is a perspective view a state in which a medium supporting tray is expended in the printer according to the invention.
Figure 3:
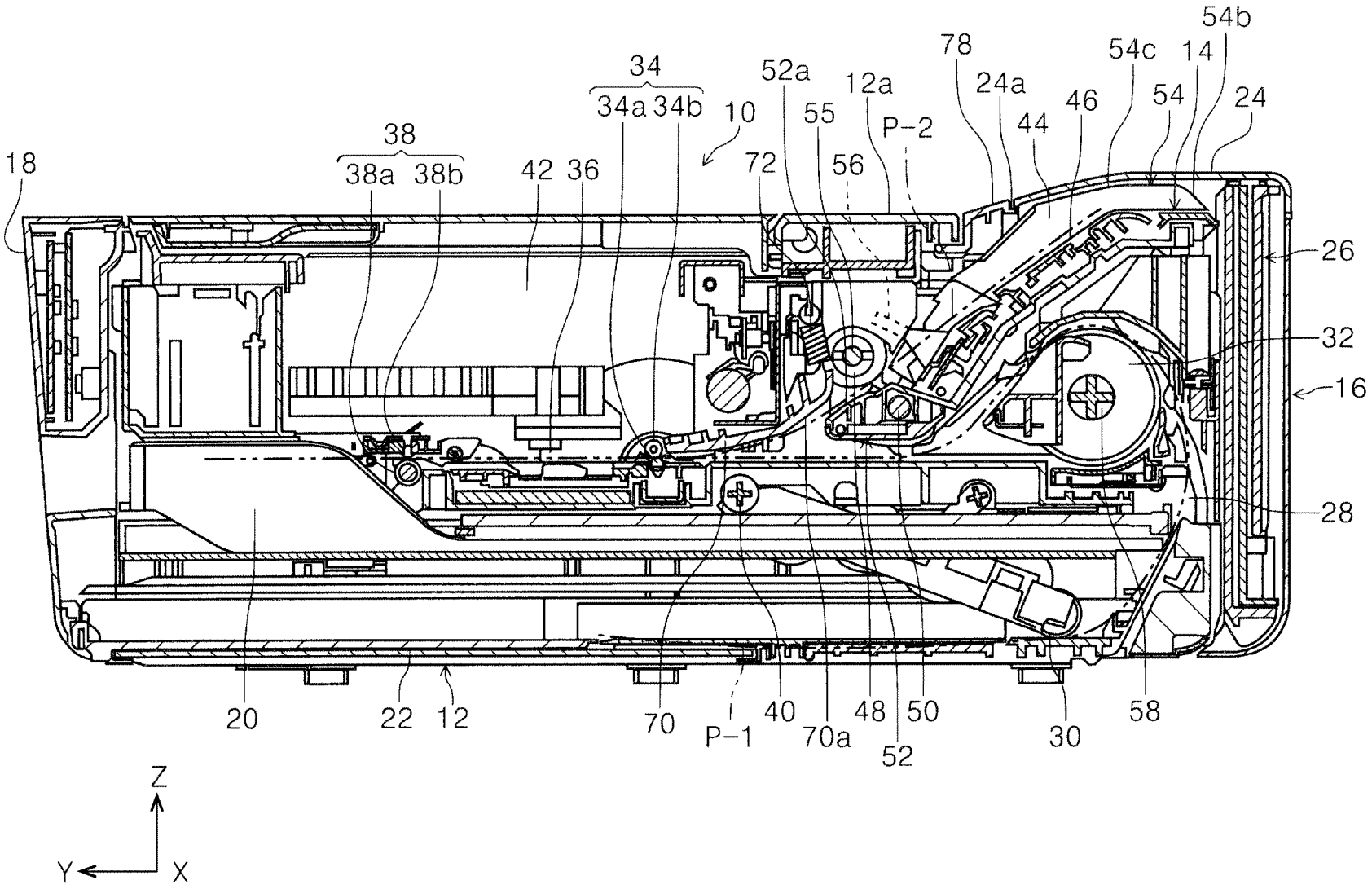
FIG. 3 is a side cross-sectional view of a medium transport path of the printer according to the invention.
Figure 4:
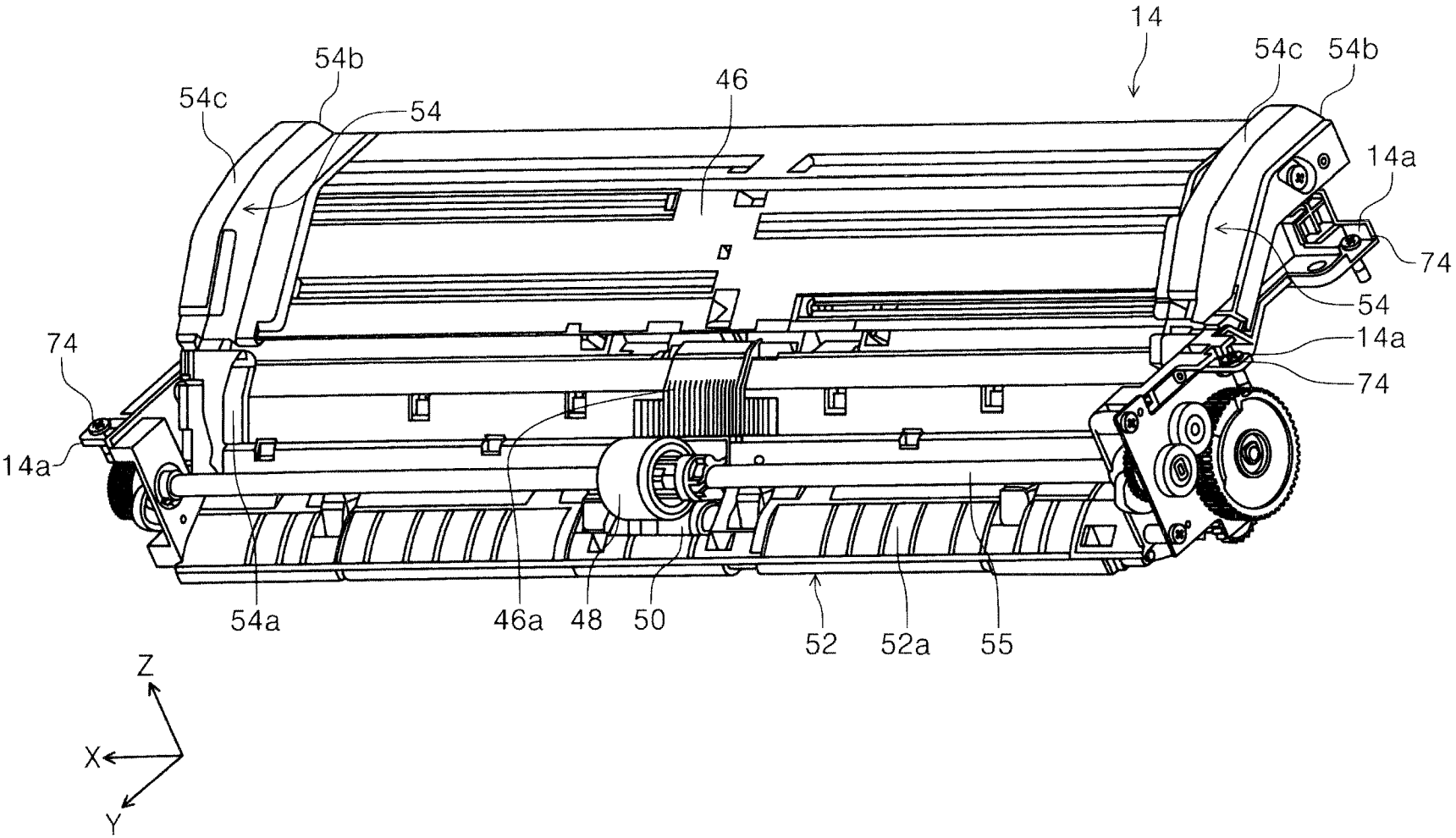
FIG. 4 is a perspective view of a medium feeding unit.

FIG. 1 is an external perspective view of a printer according to the invention, FIG. 2 is a perspective view a state in which a medium supporting tray is expended in the printer according to the invention, FIG. 3 is a side cross-sectional view of a medium transport path of the printer according to the invention, and FIG. 4 is a perspective view of a medium feeding unit.

Figure 5:
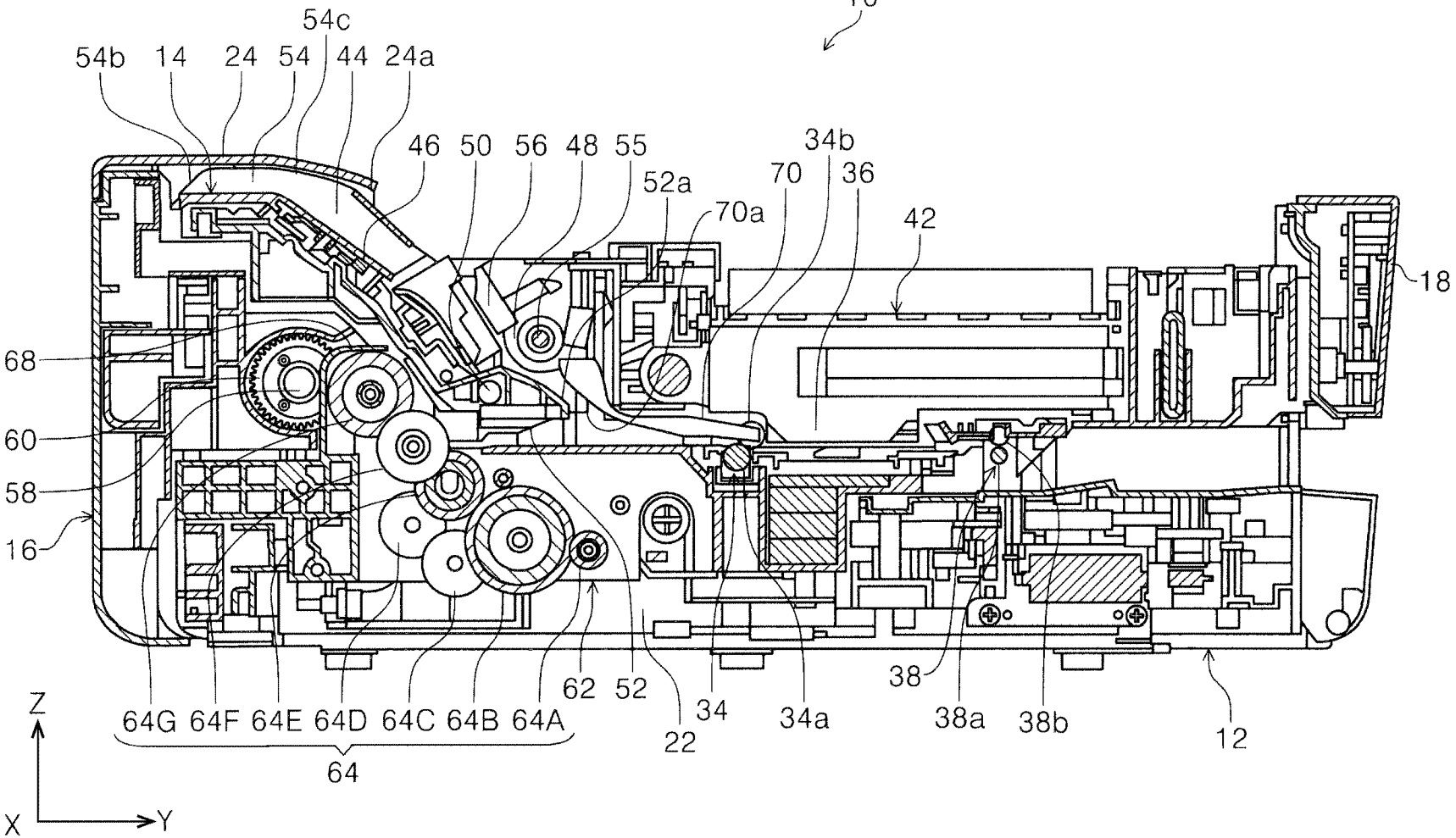
FIG. 5 is a side cross-sectional view of a state in which the medium feeding unit is mounted on an apparatus main body.
Figure 6:
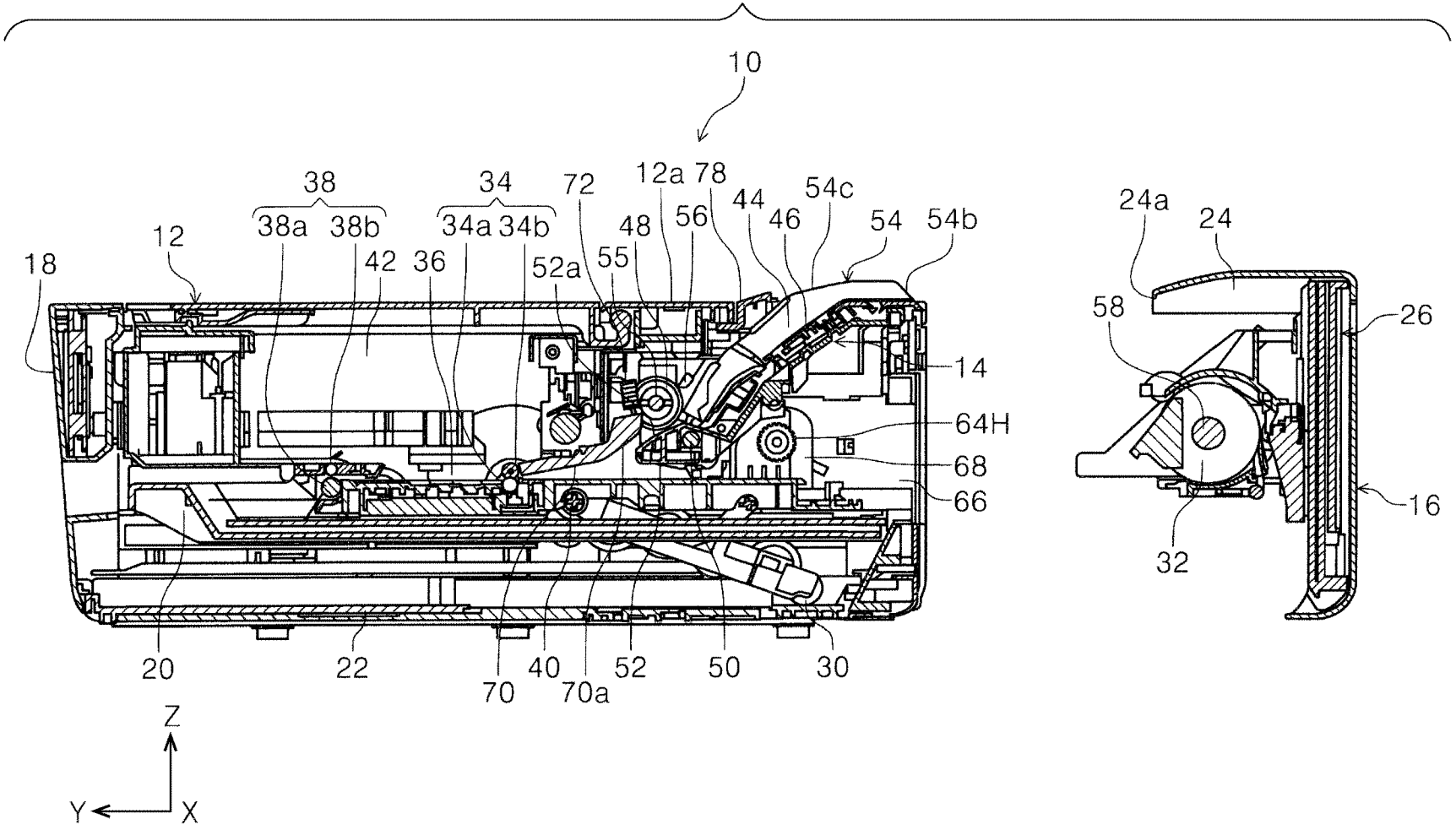
FIG. 6 is a side cross-sectional view of a state in which a medium reversing unit is separated from the apparatus main body.
Figure 7:
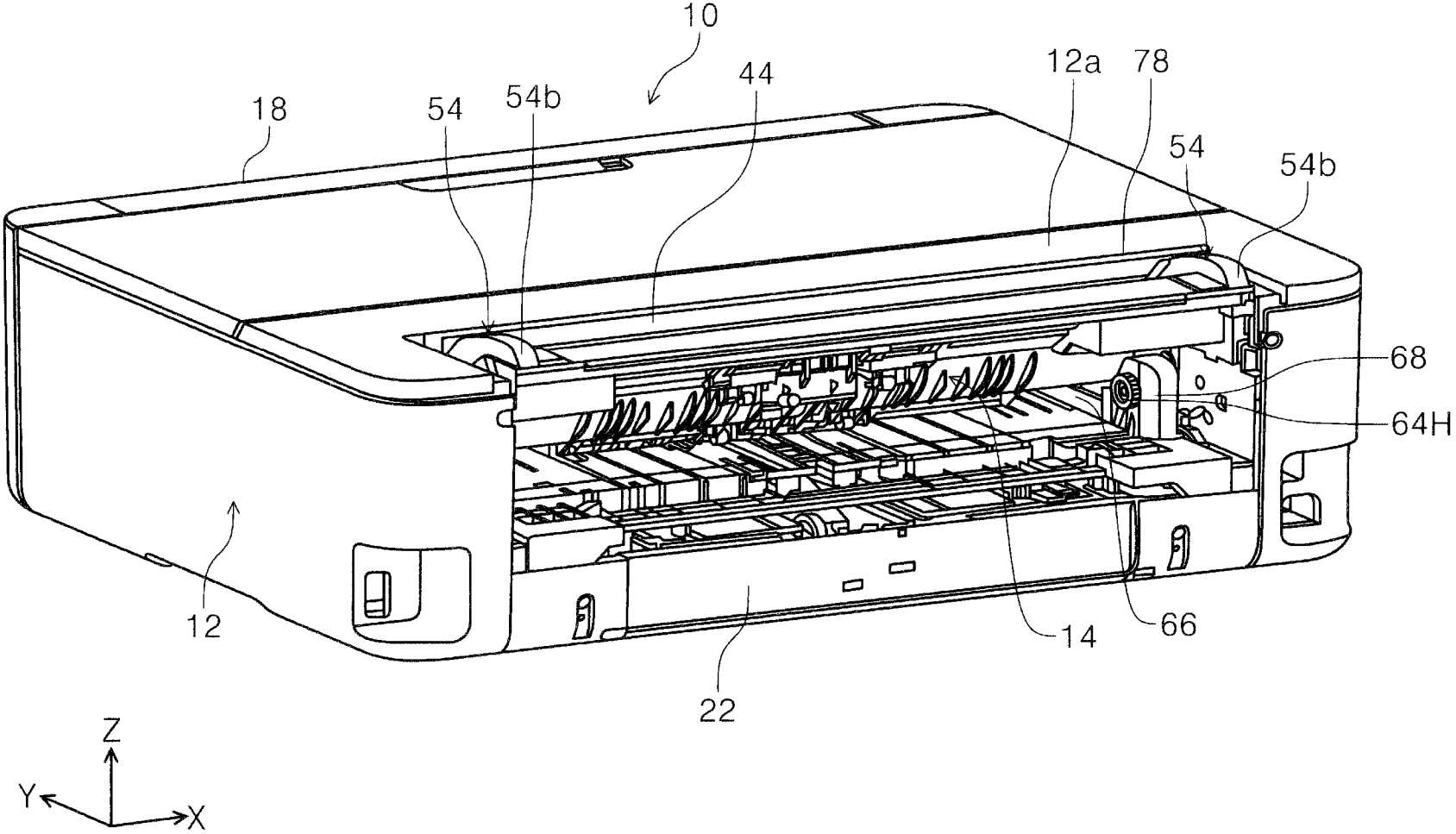
FIG. 7 is a perspective view of the apparatus main body in a state in which the medium reversing unit is separated as viewed from a rear surface side.
Figure 8:
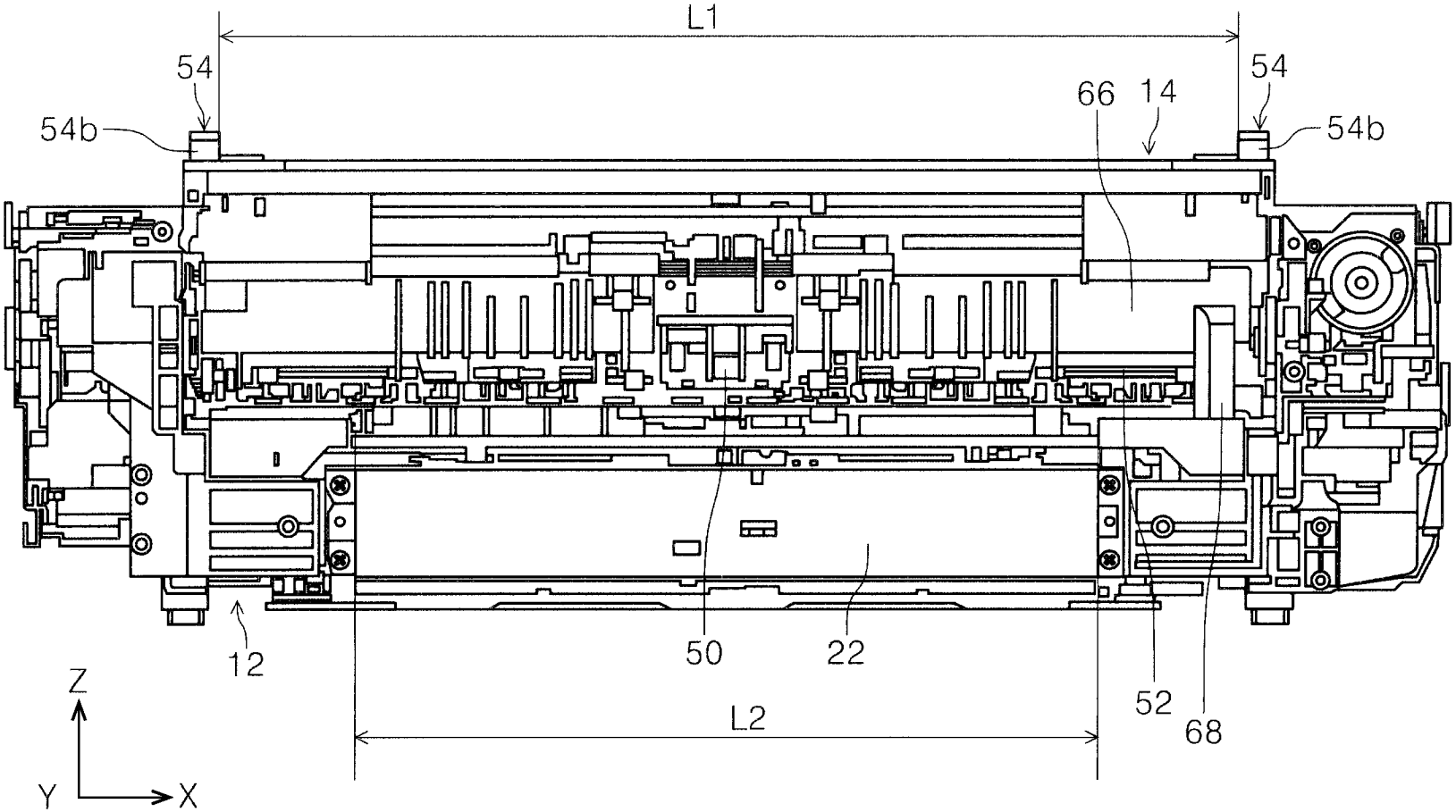
FIG. 8 is a rear view of the apparatus main body in the state in which the medium reversing unit is separated.

FIG. 5 is a side cross-sectional view of a state in which the medium feeding unit is mounted on an apparatus main body, FIG. 6 is a side cross-sectional view of a state in which a medium reversing unit is separated from the apparatus main body, FIG. 7 is a perspective view of the apparatus main body in a state in which the medium reversing unit is separated as viewed from a rear surface side, and FIG. 8 is a rear view of the apparatus main body in the state in which the medium reversing unit is separated.

Figure 9:
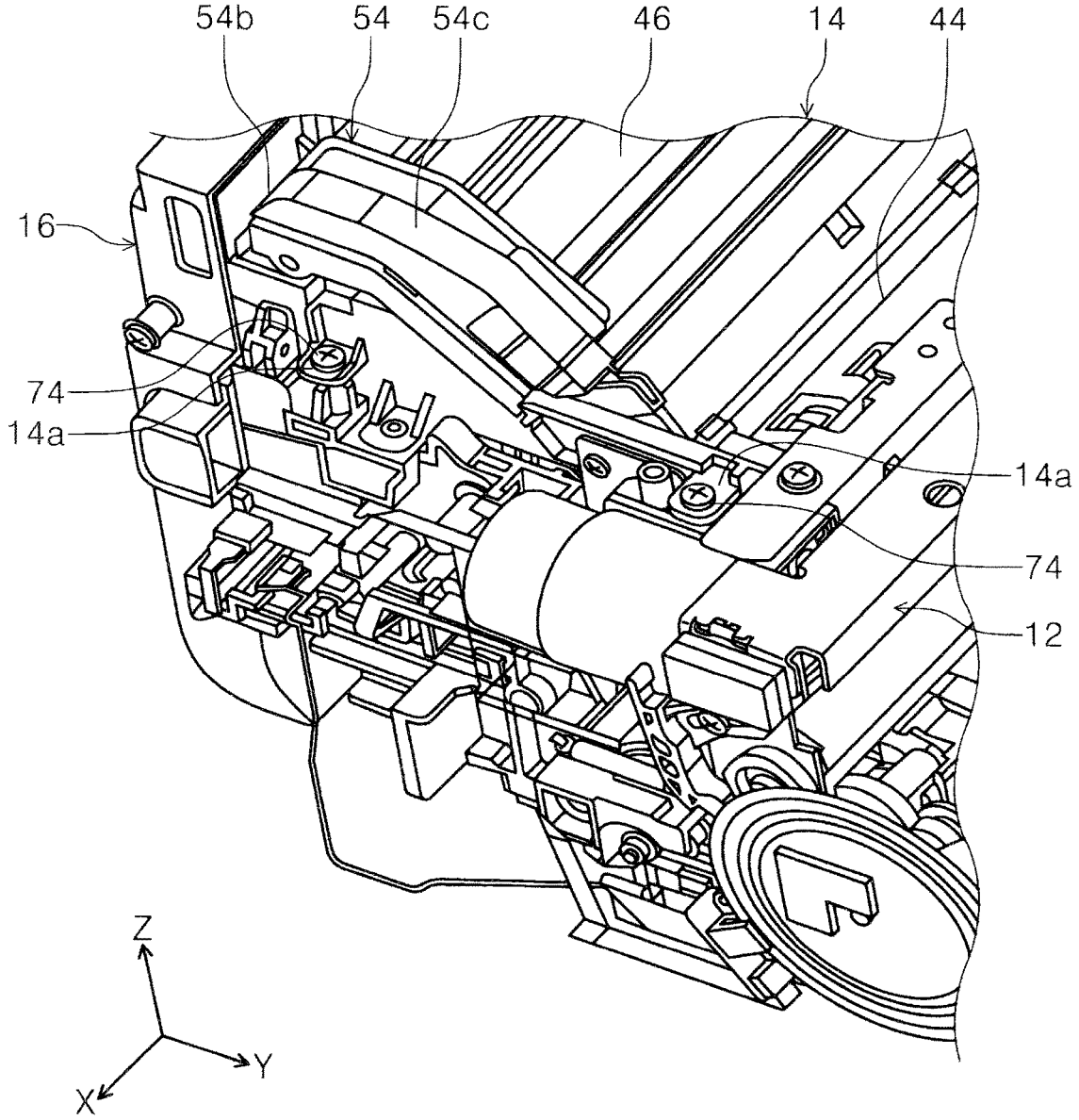
FIG. 9 is a perspective view illustrating a fastening unit of the apparatus main body and the medium feeding unit.
Figure 10:
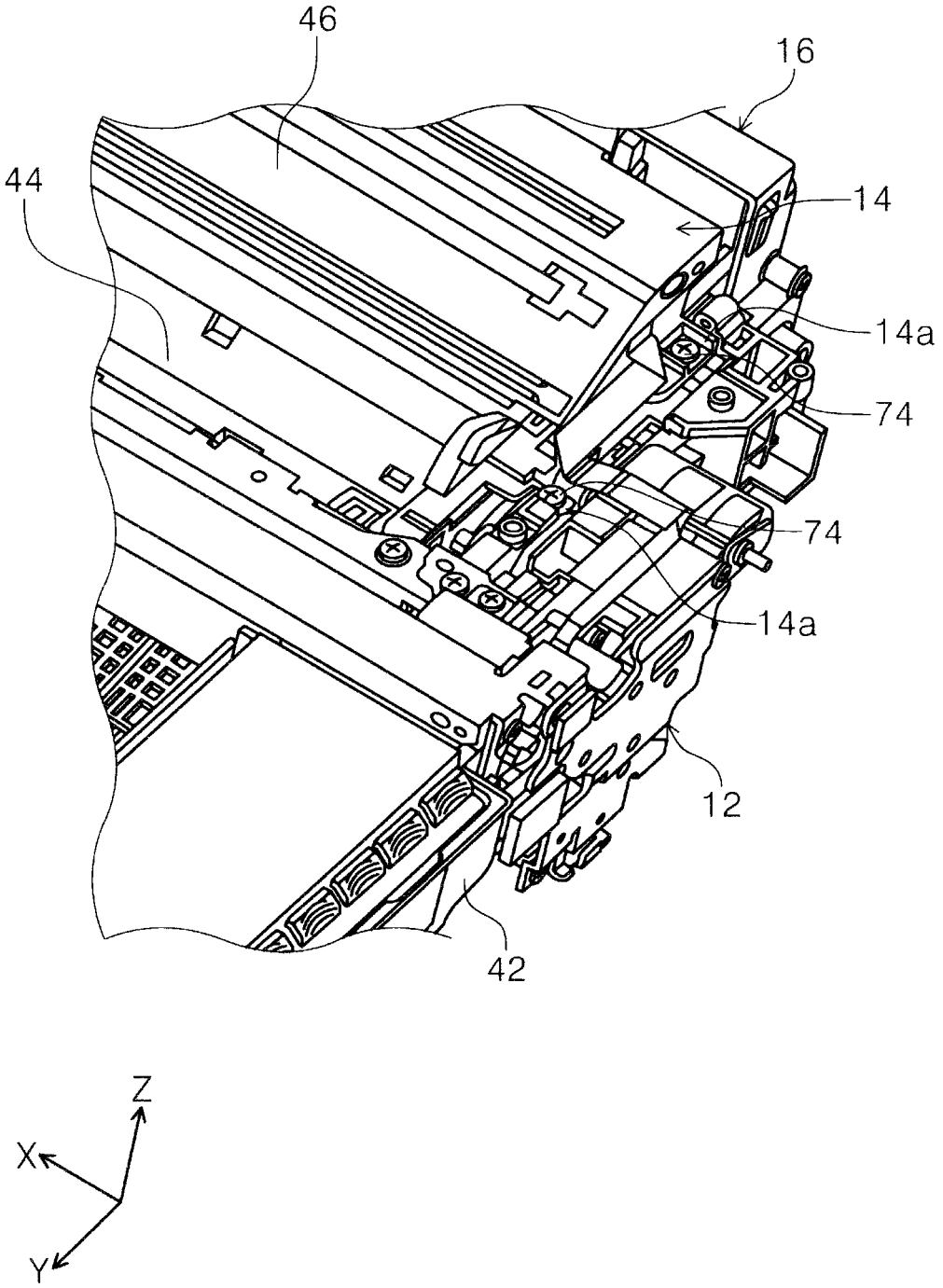
FIG. 10 is a perspective view illustrating the fastening unit of the apparatus main body and the medium feeding unit.
Figure 11:
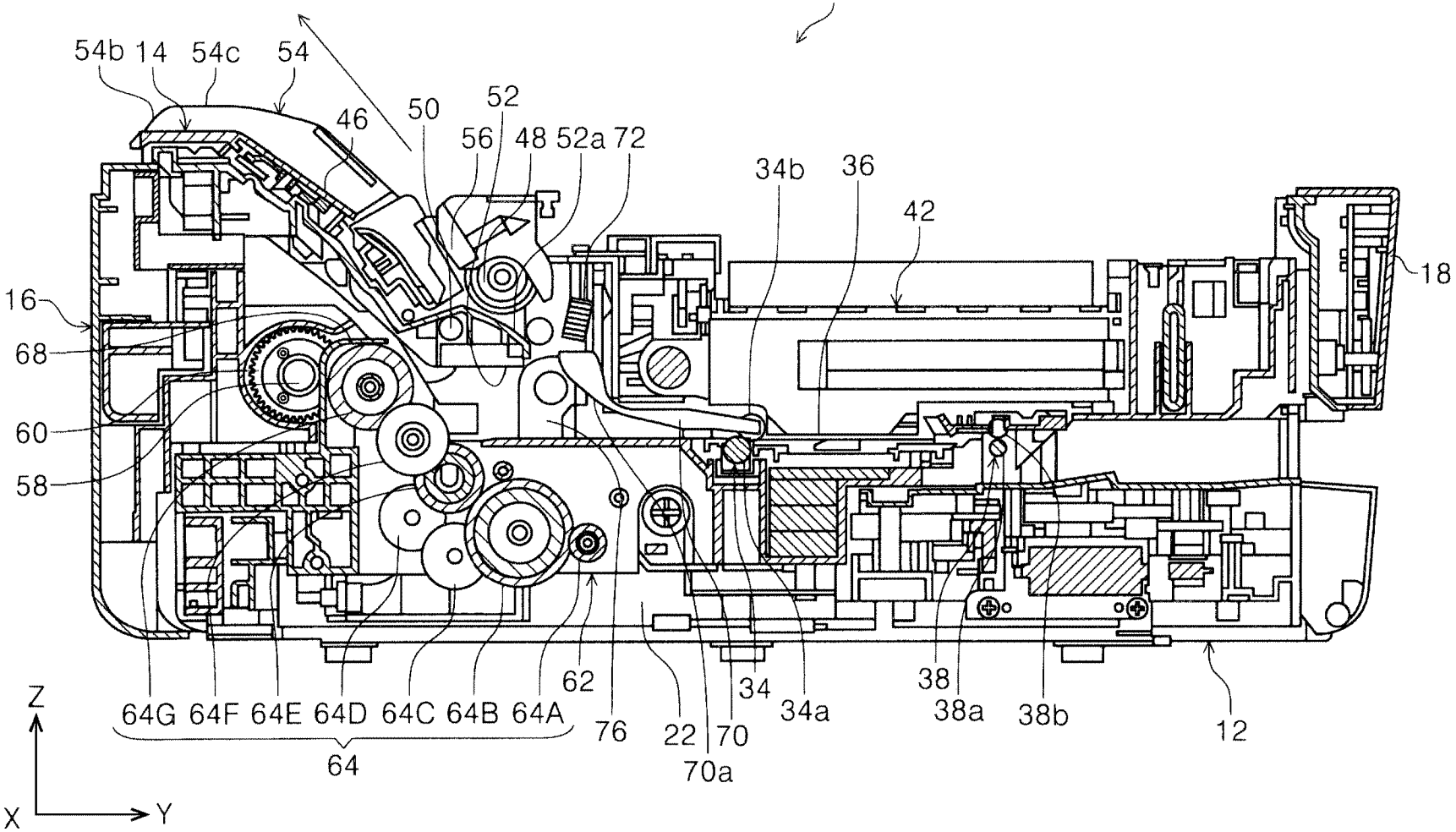
FIG. 11 is a side cross-sectional view illustrating a process of drawing the medium feeding unit from the apparatus main body.
Figure 12:
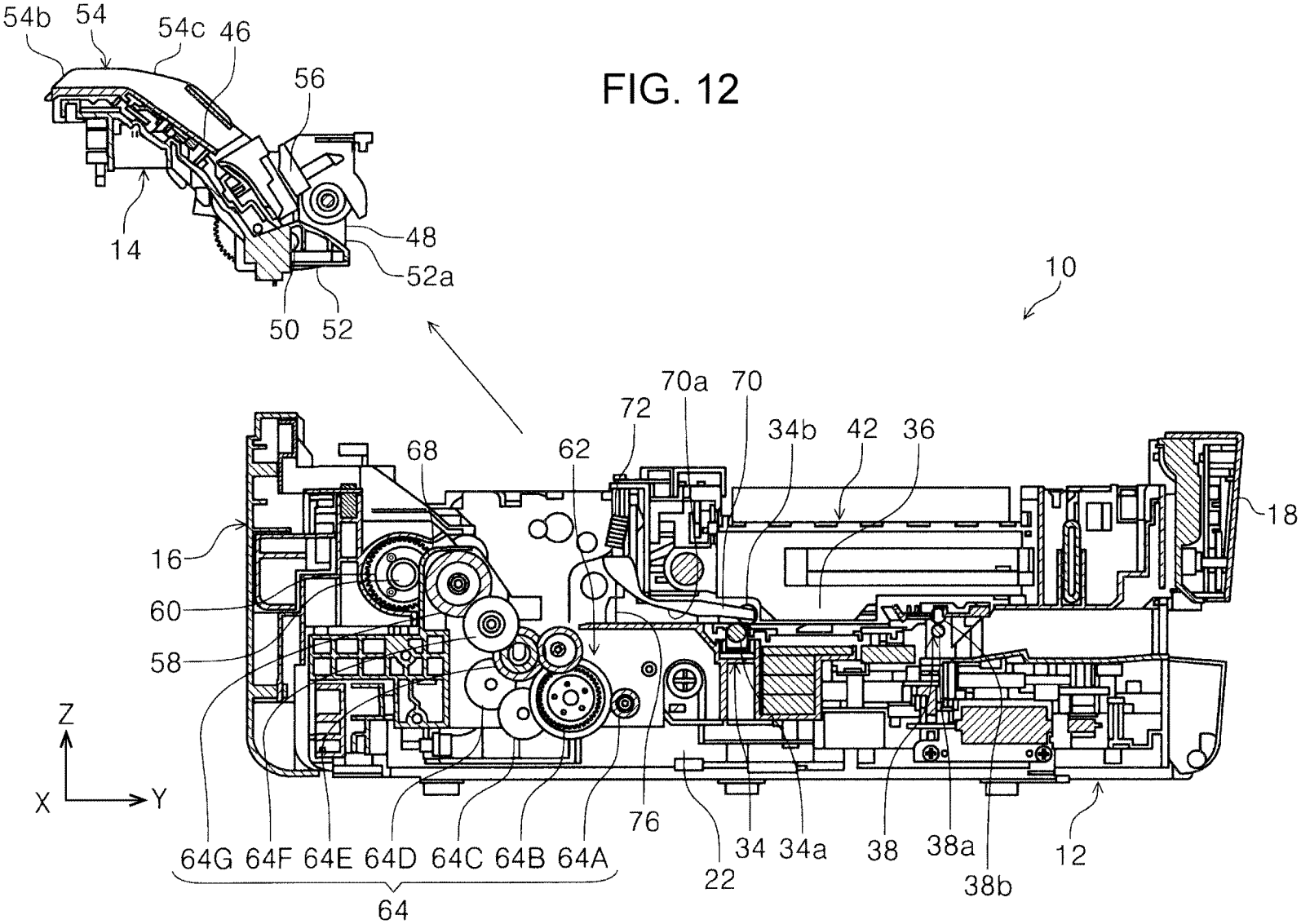
FIG. 12 is a side cross-sectional view illustrating a state in which the medium feeding unit is drawn from the apparatus main body.

FIG. 9 is a perspective view illustrating a fastening unit of the apparatus main body and the medium feeding unit, FIG. 10 is a perspective view illustrating the fastening unit of the apparatus main body and the medium feeding unit, FIG. 11 is a side cross-sectional view illustrating a process of drawing the medium feeding unit from the apparatus main body, and FIG. 12 is a side cross-sectional view illustrating a state in which the medium feeding unit is drawn from the apparatus main body.

Figure 13:
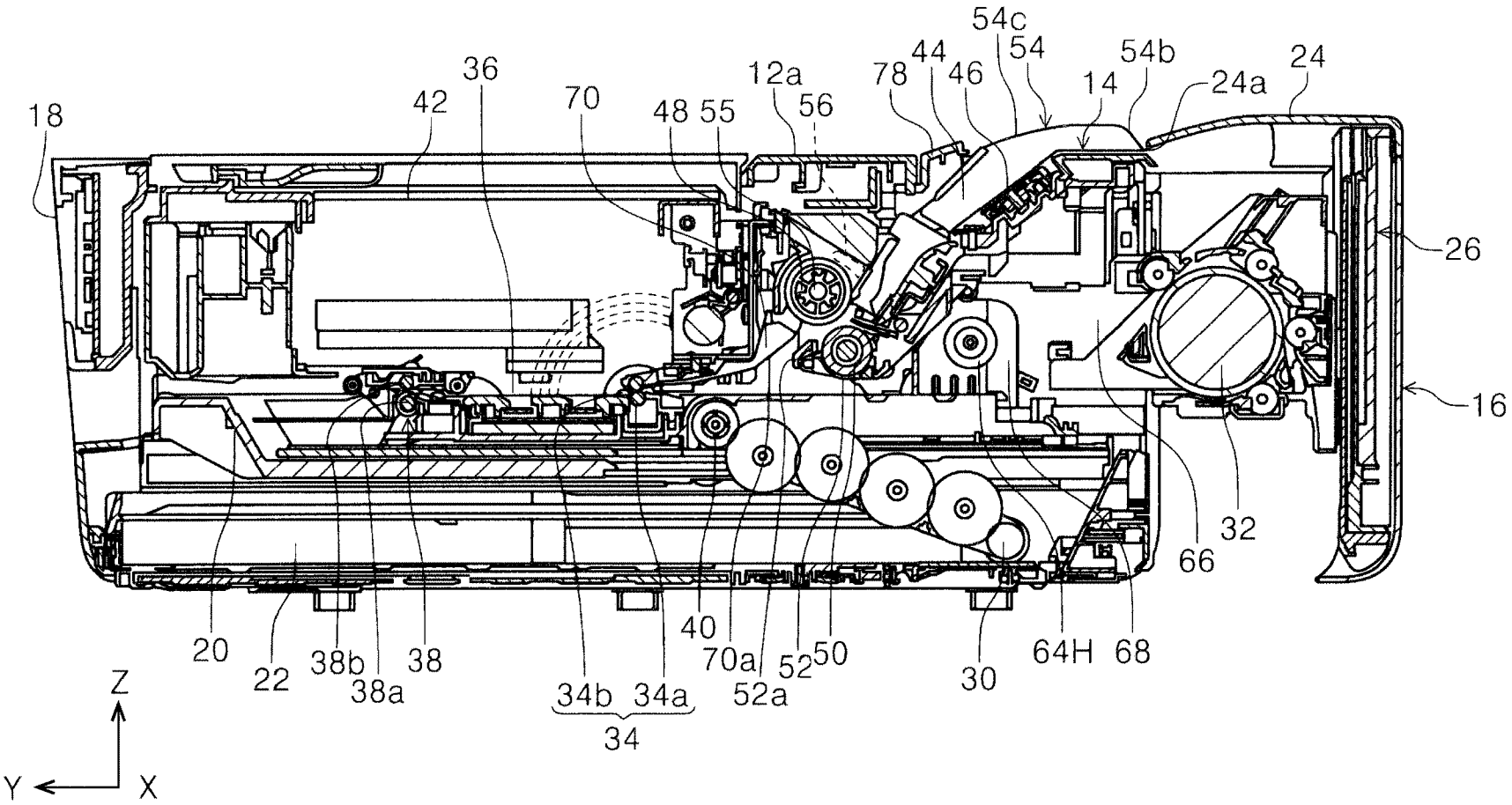
FIG. 13 is a side cross-sectional view illustrating a process of attaching the medium reversing unit to the apparatus main body.
Figure 14:
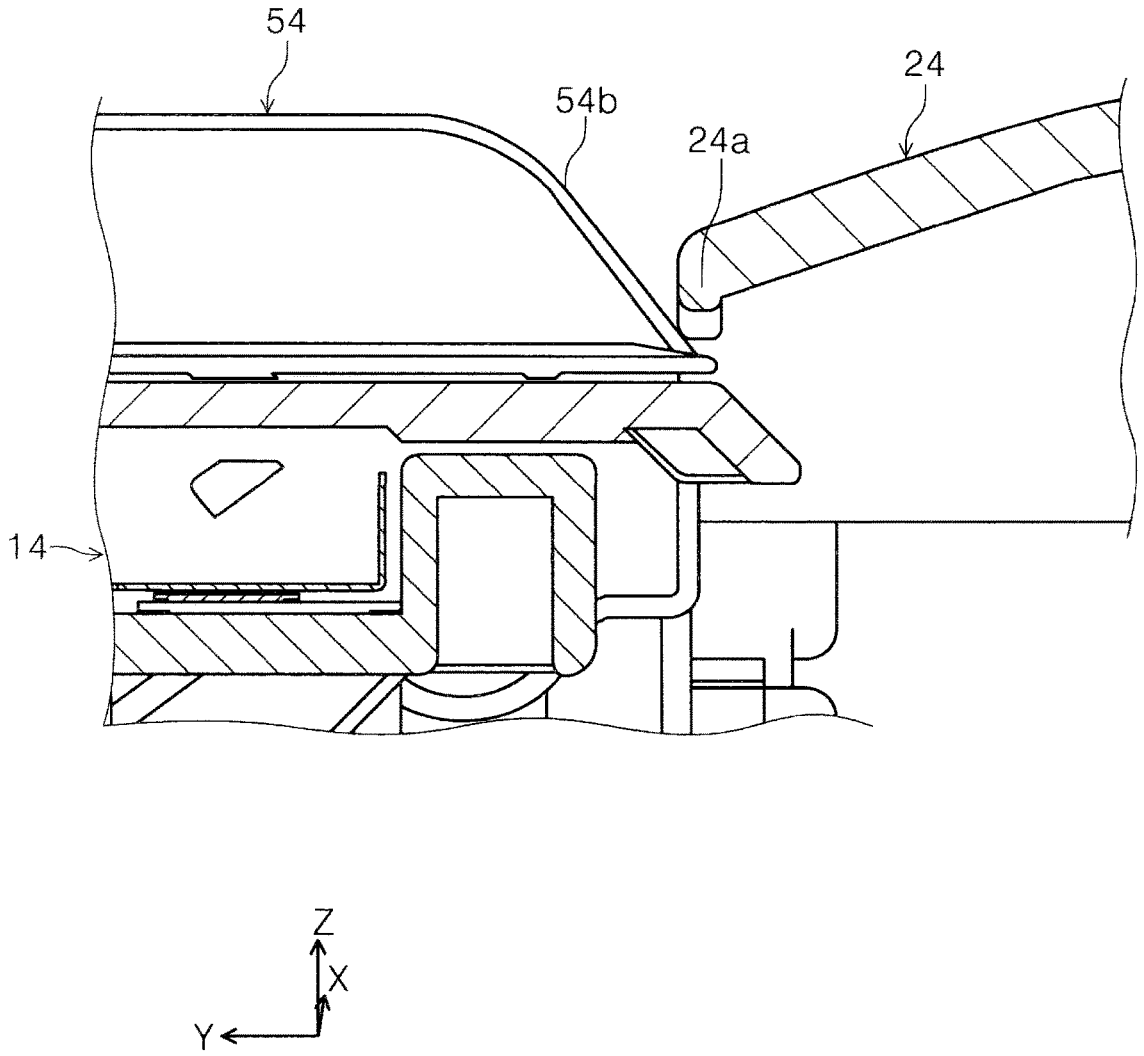
FIG. 14 is an enlarged view of a contact portion between an edge guide and a cover of the medium reversing unit in FIG. 13.
Figure 15:
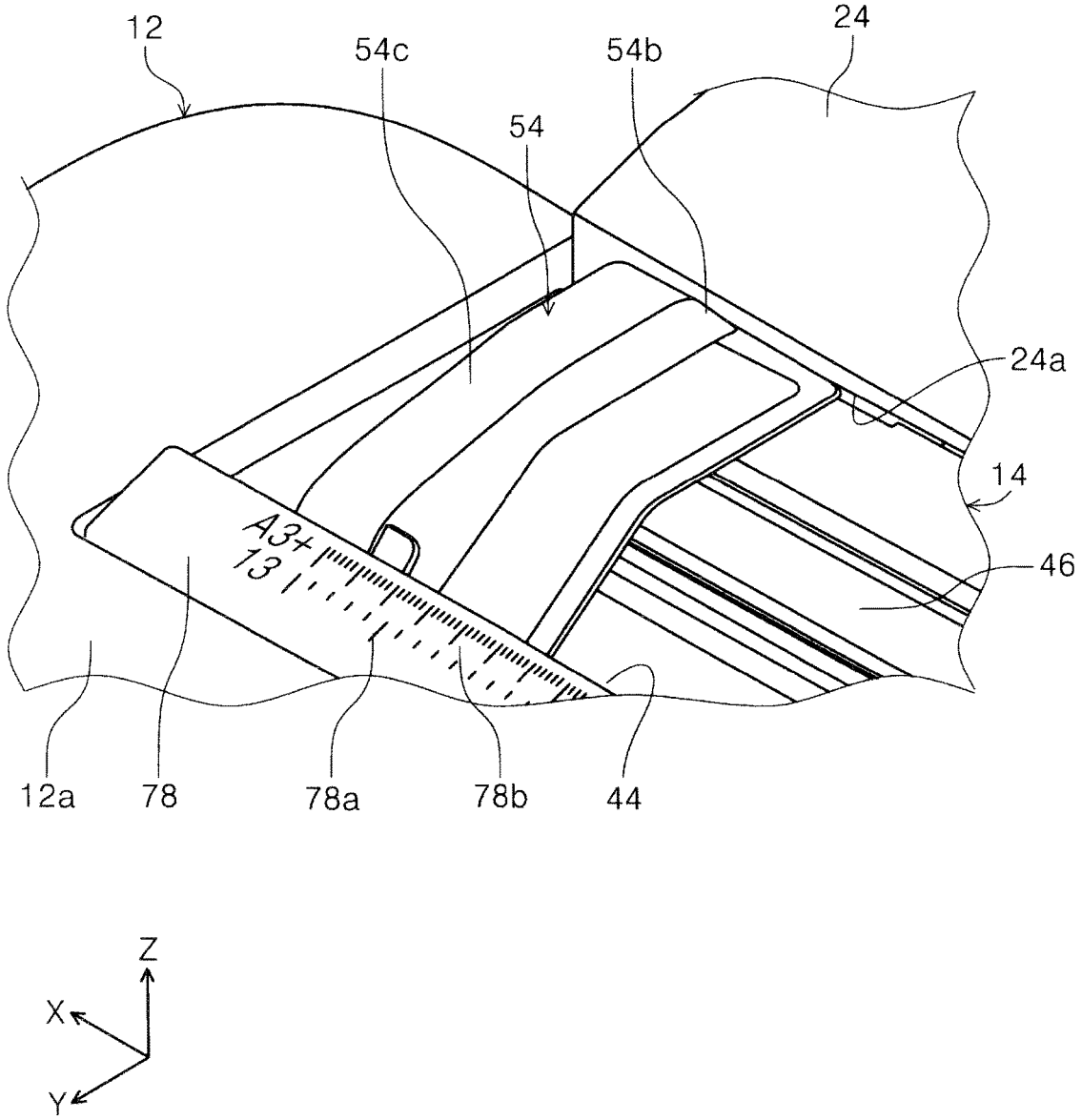
FIG. 15 is a perspective view illustrating a relationship between the edge guide and a rear feeding port cover of the medium reversing unit.

FIG. 13 is a side cross-sectional view illustrating a process of attaching the medium reversing unit to the apparatus main body, FIG. 14 is an enlarged view of a contact portion between an edge guide and a cover of the medium reversing unit in FIG. 13, and FIG. 15 is a perspective view illustrating a relationship between the edge guide and a rear feeding port cover of the medium reversing unit.

Figure 16:
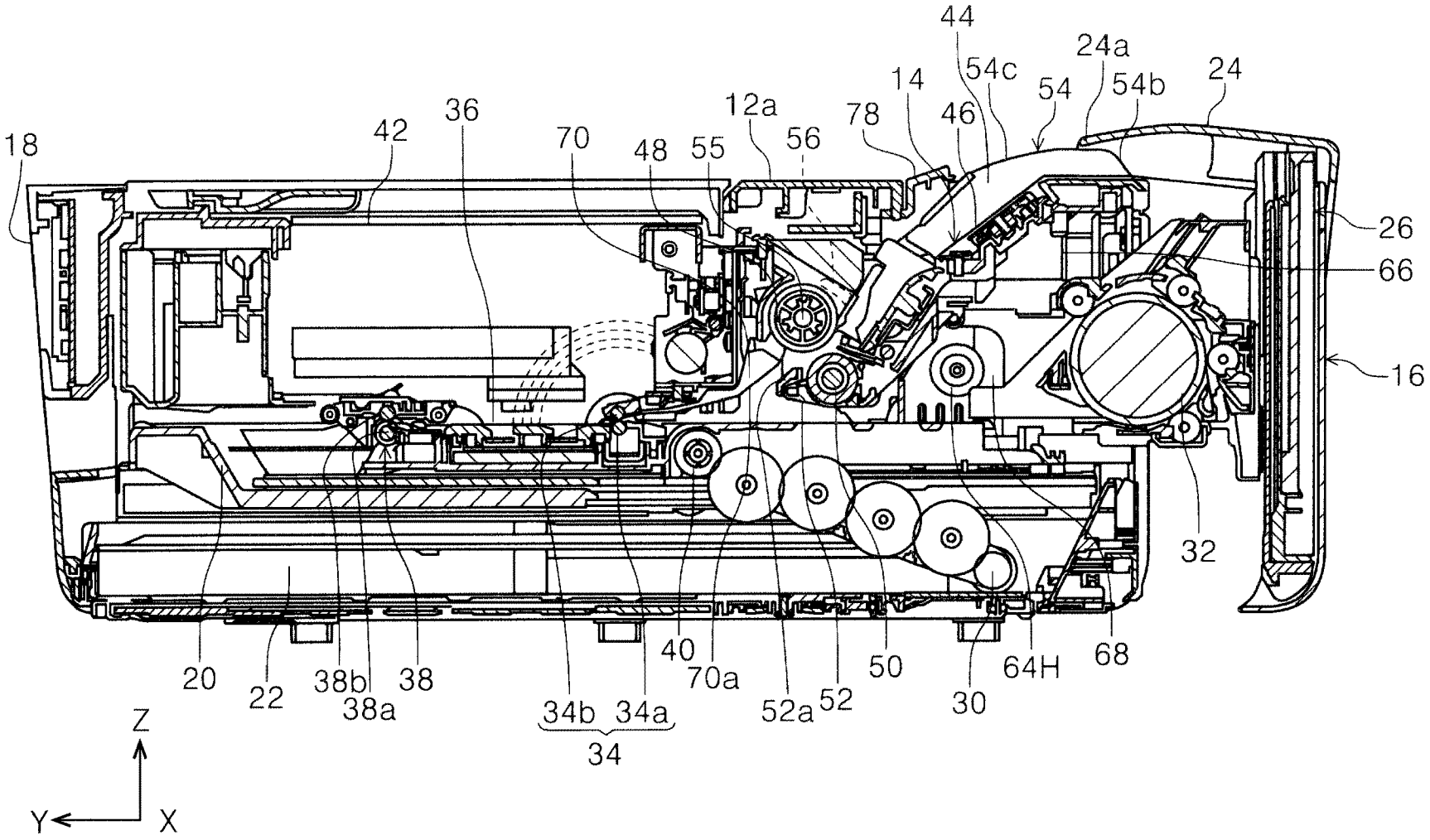
FIG. 16 is a side cross-sectional view illustrating the process of attaching the medium reversing unit to the apparatus main body.
Figure 17:
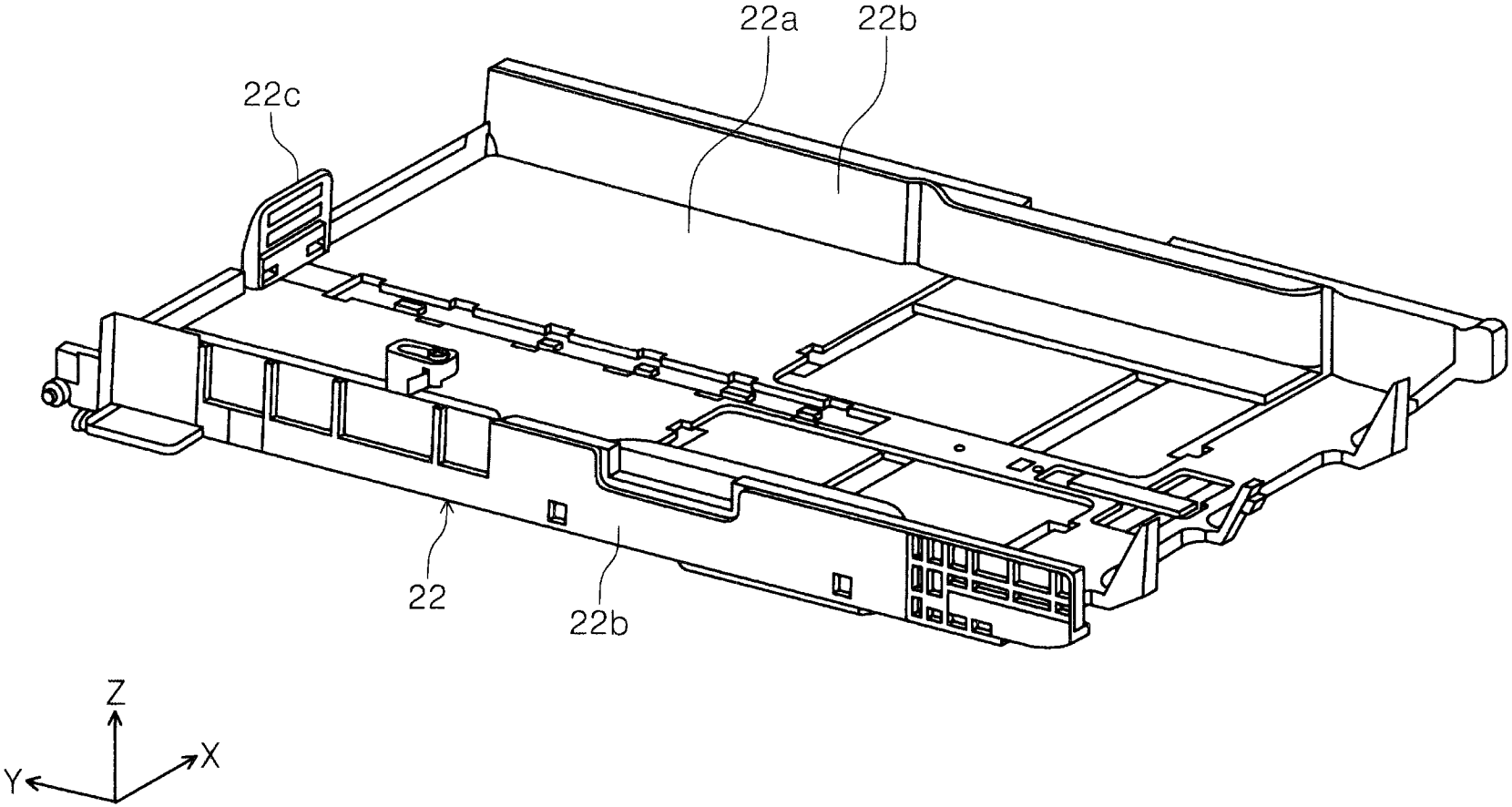
FIG. 17 is a perspective view of a state in which a rear end edge guide is stood up in a medium storage cassette.
Figure 18:
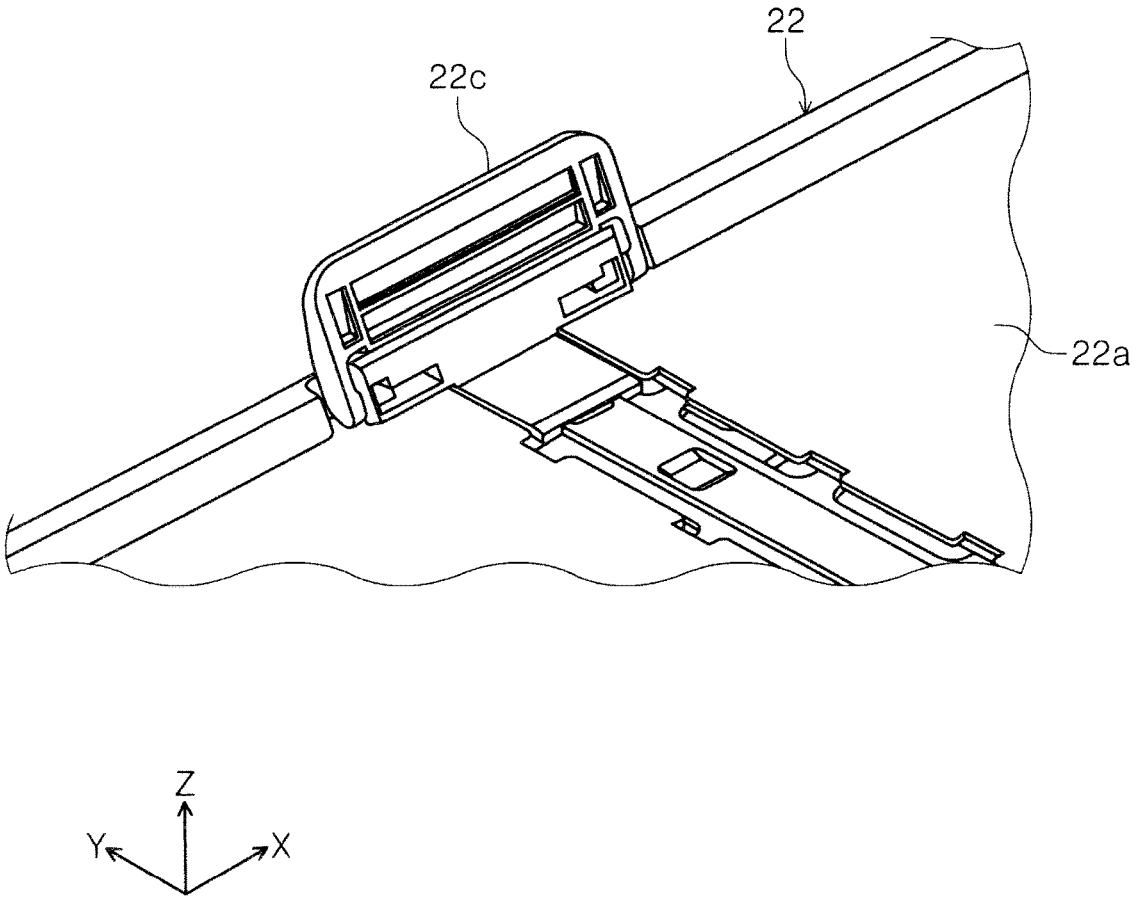
FIG. 18 is an enlarged view of the rear end edge guide in the medium storage cassette.

FIG. 16 is a side cross-sectional view illustrating the process of attaching the medium reversing unit to the apparatus main body, FIG. 17 is a perspective view of a state in which a rear end edge guide is stood up in a medium storage cassette, and FIG. 18 is an enlarged view of the rear end edge guide in the medium storage cassette.

Figure 19:
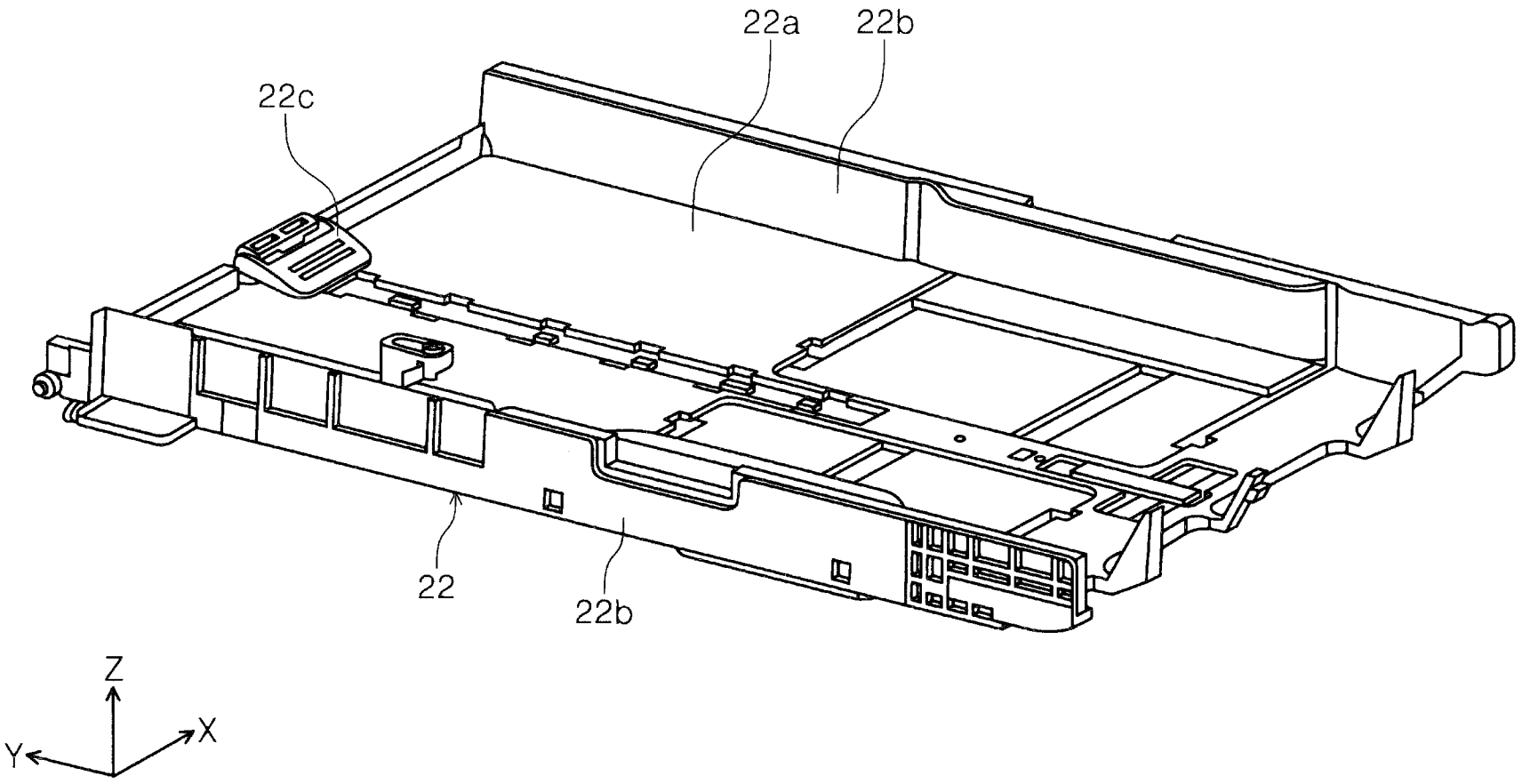
FIG. 19 is a perspective view of a state in which a rear end edge guide is fallen down in a medium storage cassette.
Figure 20:
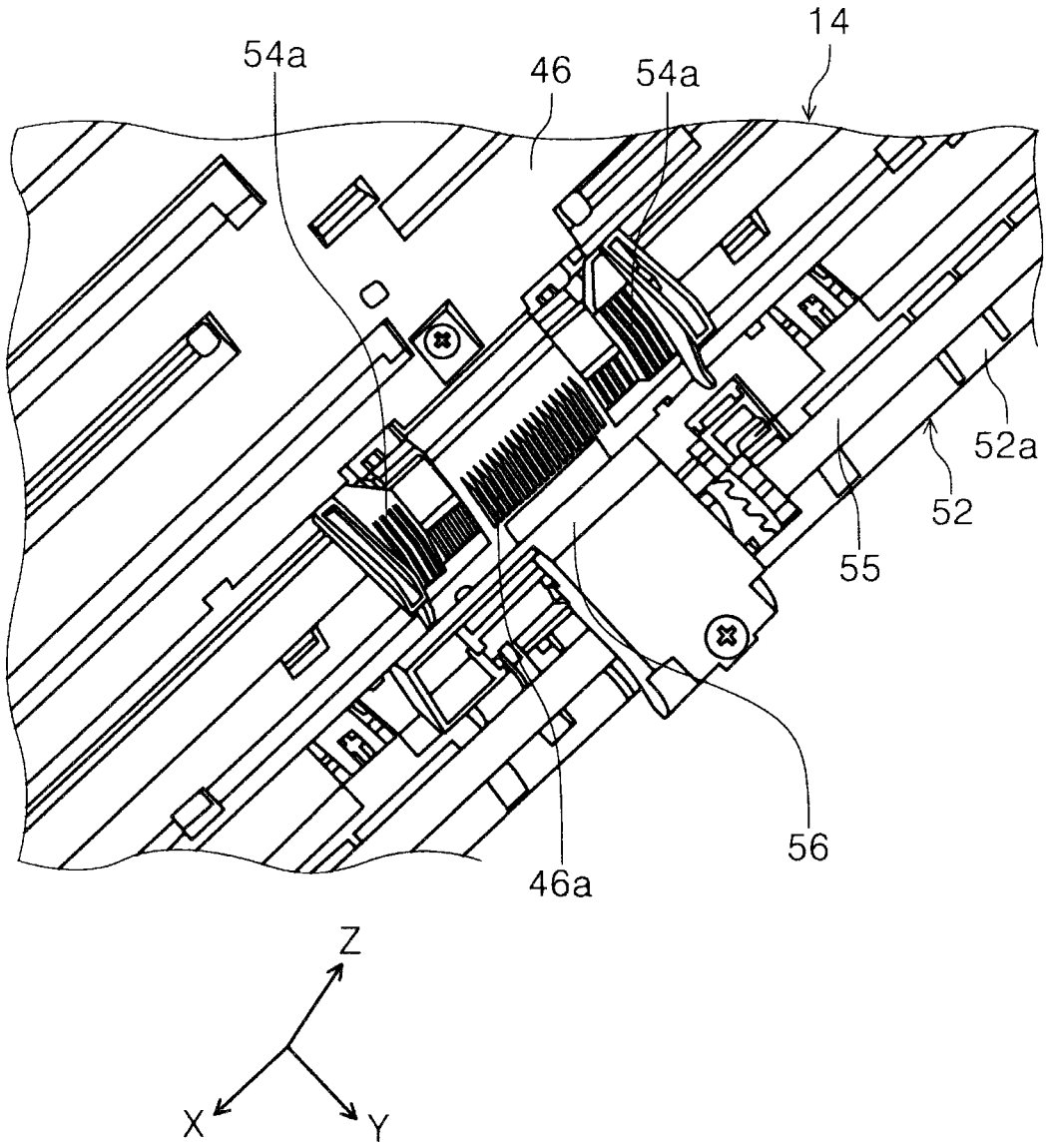
FIG. 20 is a perspective view illustrating a relationship between a medium detecting sensor and a medium supporting unit in the medium feeding unit.
Figure 21:
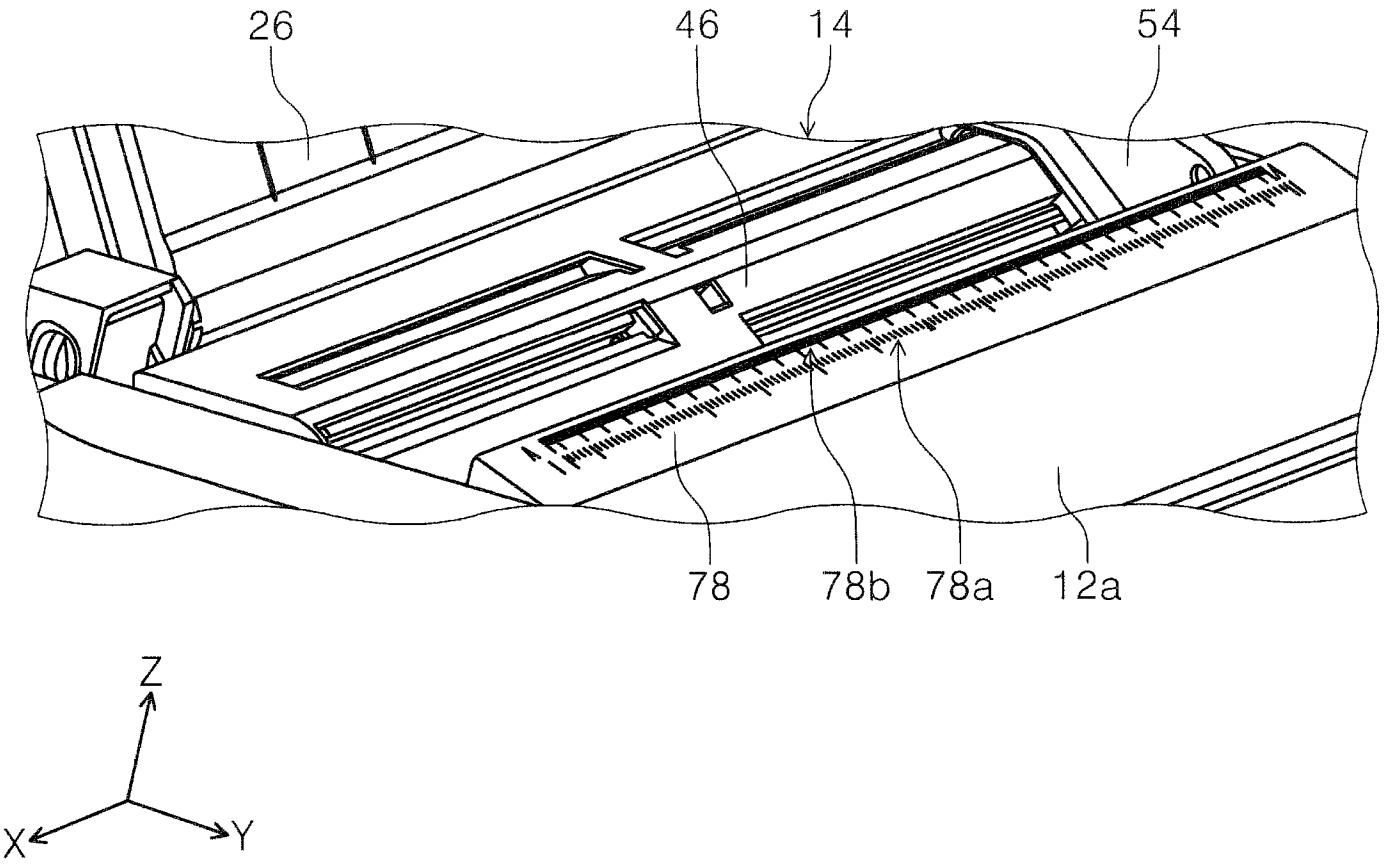
FIG. 21 is a perspective view of a scale provided at a position corresponding to the medium feeding port.
Figure 22:
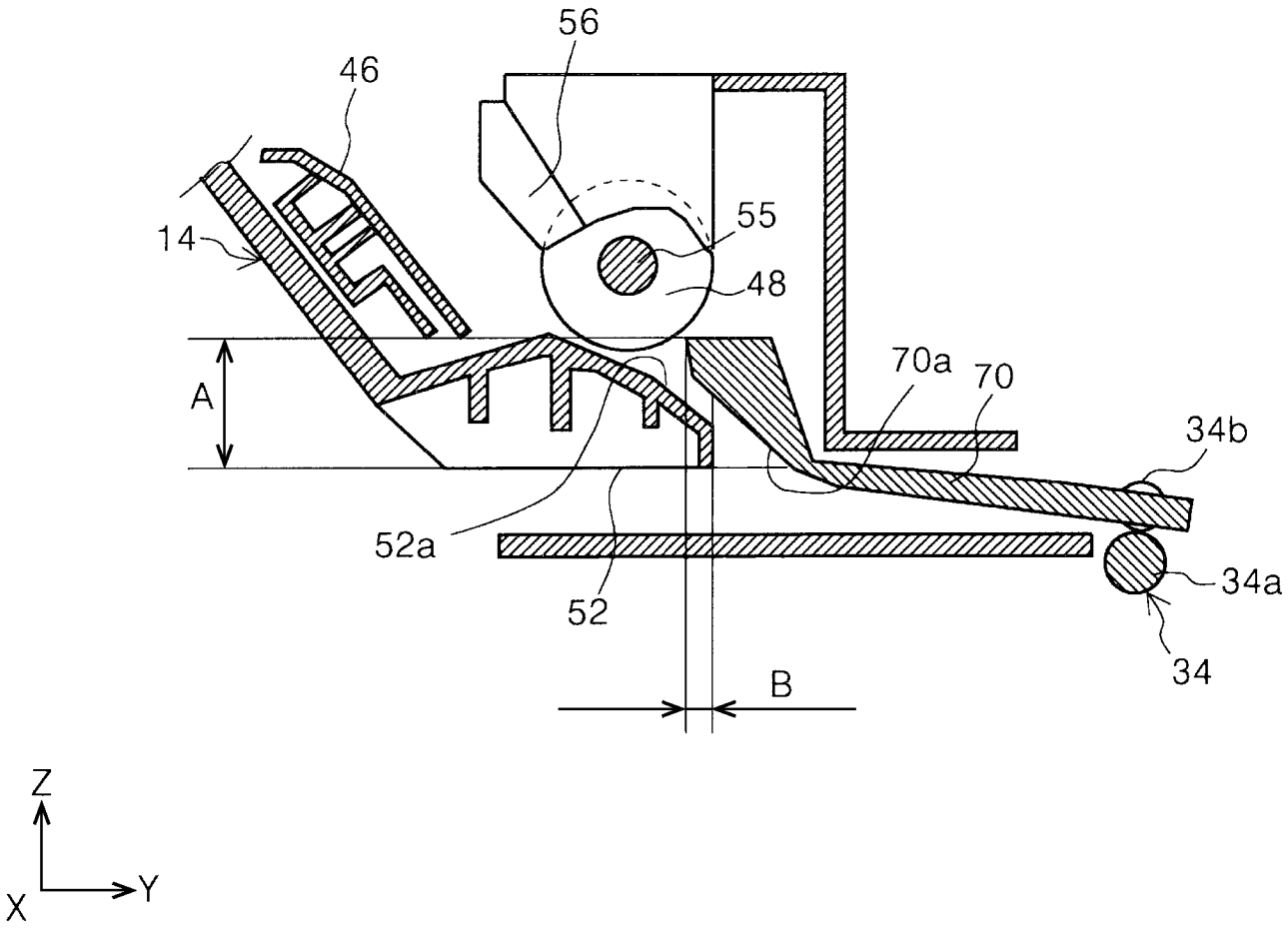
FIG. 22 is a schematic diagram illustrating a relationship between a first guide unit and a second guide unit.

FIG. 19 is a perspective view of a state in which a rear end edge guide is fallen down in a medium storage cassette, FIG. 20 is a perspective view illustrating a relationship between a medium detecting sensor and a medium supporting unit in the medium feeding unit, FIG. 21 is a perspective view of a scale provided at a position corresponding to the medium feeding port, and FIG. 22 is a schematic diagram illustrating a relationship between a first guide unit and a second guide unit.

In addition, in the X–Y–Z coordinate system illustrated in each of FIGS. 1 to 22, the X direction indicates a width direction of a recording medium, that is, an apparatus width direction, the Y direction indicates a transport direction of the recording medium in a transport path inside a recording apparatus, that is, an apparatus depth direction, and the Z direction indicates an apparatus height direction. In each of FIGS. 1 to 22, the +Y direction is a first direction and the –Y direction is a second direction.

Embodiment

Outline of Printer

An overall configuration of a printer 10 will be described with reference to FIGS. 1 and 2. The printer 10 is configured as an ink jet printer as an example of the recording apparatus. The printer 10 includes an apparatus main body 12, a medium feeding unit 14 to be described below (see FIG. 4), and a medium reversing unit 16 (see FIG. 6).

An operation unit 18 is provided on a front side (first direction side) of the apparatus main body 12. The operation unit 18 is provided with an operation unit such as a display panel, switch, or the like. A discharge tray 20 is provided in the –Z direction of the operation unit 18. The discharge tray 20 is configured to be switchable between a state (FIGS. 1 and 2) in which the discharge tray 20 is stored in the apparatus main body 12 and a state (not illustrated) in which the discharge tray 20 protrudes in a front surface direction of the apparatus main body 12 and extended on a front surface side the apparatus main body 12.

The apparatus main body 12 is provided with a medium storage cassette 22 which storages the medium on a –Z direction side of the discharge tray 20. In the present embodiment, the medium storage cassette 22 is configured to be attachable to the apparatus main body 12 and detachable from the front side of the apparatus main body 12.

A rear feeding port cover 24 is provided on an upper portion of the apparatus main body 12. The rear feeding port cover 24 is rotatably provided at an end portion on –Y direction side of the apparatus main body 12 and is configured to be switchable between a closed posture (see FIG. 1) and an opened posture (not illustrated). When the rear feeding port cover 24 is closed, the medium can be supplied to the medium feeding unit 14 described below. Further, when the rear feeding port cover 24 is opened, a medium supporting tray 26 stored in the medium reversing unit 16 described below can be drawn from the medium reversing unit 16 and can be extended on a rear side in the apparatus depth direction (second direction) in a tilted posture. The medium supporting tray in the tilted posture supports the medium set to the medium feeding unit 14 with a medium supporting unit 46 of the medium feeding unit 14 described below.

Outline of Medium Transport Path

A medium transport path 28 will be described with reference to FIG. 3. In FIG. 3, a two-dot chain line denoted by reference symbol P-1 indicates a path of the medium transported from the medium storage cassette 22 to the discharge tray 20 along the medium transport path 28. In the apparatus main body 12, a pickup roller 30, a reversing roller 32, a pair of transport rollers 34, a recording head 36 as "recording unit", and a pair of discharge rollers 38 are provided in order along the medium transport path 28.

In the present embodiment, the pair of transport rollers 34 include a transport driving roller 34*a* driven to be rotated by a driving source (not illustrated) and a transport following roller 34*b* driven to be rotated as the transport driving roller 34*a* is rotated. In the same manner, the pair of discharge rollers 38 also include a discharge driving roller 38*a* driven to be rotated by a driving source (not illustrated) and a discharge following roller 38*b* driven to be rotated as the discharge driving roller 38*a* is rotated.

The pickup roller 30 is provided on the +Z direction side of the medium storage cassette 22 and is configured to be rotatable around a rotary shaft 40 as a pivot point. Since the pickup roller 30 contacts with the medium stored in the medium storage cassette 22, the highest medium among the media stored in the medium storage cassette 22 is transported to a downstream side in the transport direction along the medium transport path 28.

The medium transmitted from the medium storage cassette 22 is reversed by the reversing roller 32 and is transmitted to the pair of transport rollers 34 on the downstream side in the transport direction. The pair of transport rollers 34 transmits the medium transmitted from the reversing roller 32 to a region opposite to the recording head 36. The recording head 36 is provided at a lower portion of a carriage 42 so that the recording head 36 can eject ink in the –Z direction. The carriage 42 is configured to be capable of reciprocating in the apparatus main body 12 in an X axis direction. The recording head 36 ejects to the ink the medium transmitted by the pair of transport rollers 34 and executes recording on a recording surface of the medium. The recorded medium is nipped between the pair of discharge rollers 38 provided on the downstream side of the recording head 36 in the transport direction and is discharged toward the discharge tray 20 which protrudes to the front side of the apparatus main body 12.

In FIG. 3, a one-dot chain line denoted by reference symbol P-2 indicates a transport path of the medium transported from a feeding port 44 to the recording head 36, that is, the transport path from the medium feeding unit 14 to the recording head 36. When the rear feeding port cover 24 is opened to the apparatus main body 12, the feeding port 44 (see FIG. 3) is revealed. The medium can be inserted into the apparatus main body 12 via the feeding port 44. The medium supporting unit 46 is provided on the downstream side of the feeding port 44 in the medium transport direction. The medium supporting unit 46 supports the medium inserted from the feeding port 44 in the tilted posture. In the present embodiment, the medium supporting unit 46 is configured as a hopper as an example. A portion of the hopper on the downstream side in the medium transport direction can be swung in a separation/contact direction from/to a feeding roller 48.

The feeding roller 48 is provided on the downstream side of the medium supporting unit 46 in the medium transport direction. A separating roller 50 is provided at a position opposite to the feeding roller 48 in a −Z axis direction of the feeding roller 48.

The medium supported by the medium supporting unit 46 in the tilted posture is nipped between the feeding roller 48 and the separating roller 50 and is transported to the pair of transport rollers 34. The pair of transport rollers 34 transmits the medium transmitted from the feeding port 44 to a region opposite to the recording head 36. After then, the recording head 36 executes recording on the transmitted medium and the pair of discharge rollers 38 discharge the medium to the discharge tray 20.

In FIG. 3, in a case where a second surface of the medium, of which a first surface is recorded, is recorded at a position opposite to the recording head 36, the pair of transport rollers 34 are reversely rotated and are transported to the reversing roller 32 through a first guide unit 52 in a lower direction as a rear end side of the medium is exchanged with a tip. The reversing roller 32 reverses the first surface of the medium reversely transported by the reversing roller 32 with the second surface and transmits the medium from the medium reversing unit 16 through the first guide unit 52 in the lower direction to a position opposite to the recording head 36. The recording head 36 performs recording on the second surface of the medium. After then, the pair of discharge rollers 38 discharge the medium to the discharge tray 20.

Medium Feeding Unit

Next, the medium feeding unit 14 will be described with reference to FIG. 4. The medium feeding unit 14 is configured to be attachable to and detachable from the apparatus main body 12. The medium feeding unit 14 attachable to and detachable from the apparatus main body 12 will be described below. In the present embodiment, the medium feeding unit 14 includes the medium supporting unit 46 in a downward slope shape from a rear surface side of the apparatus (second direction side) to the front surface side of the apparatus (first direction side), the feeding roller 48, the separating roller 50, and the first guide unit 52.

The medium supporting unit 46 supports the medium inserted from the feeding port 44 in the tilted posture. The medium supporting unit 46 is provided with a pair of edge guides 54. The edge guide 54 is configured to be displaced in the apparatus width direction (X axis direction).

The feeding roller 48 and the separating roller 50 are provided on the downstream side of the medium supporting unit 46 in the medium transport direction. The feeding roller 48 is attached to a central portion of a rotary shaft 55 extending in the apparatus width direction. Both ends of the rotary shaft 55 in the apparatus width direction are rotatably supported by the medium feeding unit 14. The separating roller 50 is rotatably attached to the first guide unit 52 at a position opposite to the feeding roller 48 in the medium transport direction.

In the present embodiment, a medium detecting sensor 56 (FIGS. 5, 11, 12, and the like) is provided at a position opposite to the feeding roller 48 in the medium transport direction. In the present embodiment, as an example, the medium detecting sensor 56 is configured as an optical sensor.

In the present embodiment, a false detection preventing unit 46*a* (FIGS. 4 and 20) is provided at a position opposite to the medium detecting sensor 56 in the medium supporting unit 46. As an example, the false detection preventing unit 46*a* is formed in a concavo-convex shape to irregularly reflect external light so that the medium detecting sensor 56 is not detected. Further, in a state in which the edge guide 54 is displaced at a central portion in the apparatus width direction, a false detection preventing unit 54*a* (FIGS. 4 and 20) in a concavo-convex shape in the same manner as the false detection preventing unit 46*a* is formed at a portion of the edge guide 54 opposite to the medium detecting sensor 56. In FIG. 20, only the portion of the edge guide 54 opposite to the medium detecting sensor 56 is illustrated, but other portions are not illustrated.

As illustrated in FIG. 4, the first guide unit 52 is provided on the downstream side of the feeding roller 48 and the separating roller 50 in the medium transport direction. An upper surface of the first guide unit 52 is formed as a first guide surface 52*a*. The first guide surface 52*a* is formed in the downward slope from an upstream side to a downstream side in the medium transport direction.

Medium Reversing Unit

The medium reversing unit 16 will be described with reference to FIGS. 5 and 6. The medium reversing unit 16 can be mounted on the apparatus main body 12. The medium supporting tray 26 is attached on the rear surface side (−Y axis direction side) of the medium reversing unit 16 and can be stored in the medium reversing unit 16. The reversing roller 32 is rotatably provided on the front side (+Y axis direction side) of the medium reversing unit 16. The rear feeding port cover 24 is attached to an upper portion of the medium reversing unit 16 and can be rotated around the medium reversing unit 16.

In FIG. 6, the reversing roller 32 is attached to a rotary shaft 58. For example, a reversing roller driving gear 60 illustrated in FIG. 5 is attached to an end portion on the +X axis direction side of the rotary shaft 58.

Power Transmission Unit

In the present embodiment, in a state in which the medium reversing unit 16 is mounted on the apparatus main body 12, the reversing roller driving gear 60 receives a power from a power transmission unit 62 provided inside the apparatus main body 12 so that the reversing roller 32 is rotated.

In FIG. 5, the power transmission unit 62 includes a plurality of gears 64A, 64B, 64C, 64D, 64E, 64F, and 64G.

In the present embodiment, the gear 64A is engaged with the gear 64B, the gear 64B is engaged with the gear 64C, the gear 64C is engaged with the gear 64D, the gear 64D is engaged with the gear 64E, the gear 64E is engaged with the gear 64F, and the gear 64F is engaged with the gear 64G. Further, in FIGS. 6 and 7, the power transmission unit 62 is provided coaxially with the gear 64G and includes a gear 64H which rotates together with the gear 64G.

In the present embodiment, a driving motor (not illustrated) is provided inside the apparatus main body 12 as a power source of the medium reversing unit 16. In the present embodiment, when driving the driving motor (not illustrated), the gear 64A is rotated. When the gear 64A is rotated, the gears 64B, 64C, 64D, 64E, 64F, 64G, and 64H are rotated in order.

In the present embodiment, when the medium reversing unit 16 is mounted on the apparatus main body 12, the reversing roller driving gear 60 and the gear 64H are engaged with each other. Accordingly, a power from the driving motor (not illustrated) is transmitted to the reversing roller driving gear 60 via the power transmission unit 62 and the reversing roller 32 is driven to rotate.

In FIG. 5, the gears 64A and 64B of the power transmission unit 62 are disposed on a lower direction side of the first guide unit 52 of the medium feeding unit 14 in the apparatus height direction. Therefore, at least a part of the first guide unit 52 overlaps with a part of the power transmission unit 62 in the apparatus height direction. On the other hand, the gears 64F, 64G, and 64H are disposed on the rear surface side (second direction side) of the first guide unit 52 of the medium feeding unit 14 in the apparatus depth direction.

In the present embodiment, the gears 64B, 64C, 64D, 64E, 64F, 64G, and 64H are provided from a position at which the gear 64A is provided in a lower portion of the apparatus main body 12 toward the rear surface side of the apparatus in a diagonally upward direction (drawing direction of first guide unit 52 described below).

In FIGS. 6 to 8, when the medium reversing unit 16 is separated from the apparatus main body 12, a space 66 is formed on the rear surface side of the medium supporting unit 46 of the medium feeding unit 14 in the apparatus depth direction. Inside the space 66 in FIGS. 7 and 8, a power transmission unit cover 68 is disposed at a position close to an end portion on +X direction side of the apparatus main body 12. The power transmission unit cover 68 covers a part of the power transmission unit 62 positioned inside the space 66. Specifically, the power transmission unit cover 68 covers the gear 64F and the gear 64G positioned on the rear surface side of the apparatus of the first guide unit 52, so that accidental access to the power transmission unit 62 in the space 66 is prevented. In the present embodiment, only the gear 64H provided coaxially with the gear 64G is revealed inside the space 66.

In FIG. 8, a region denoted by reference symbol L1 in the apparatus width direction indicates a width size of the medium which can be fed by the medium feeding unit 14. Further, a region denoted by reference symbol L2 in the apparatus width direction indicates the width size of the medium which can be fed from the medium storage cassette 22 toward a position opposite to the recording head 36. In the present embodiment, as an example, the width size of the medium which can be fed by the medium feeding unit 14 is set larger than the width size of the medium which can be fed from the medium storage cassette 22. For example, when the medium with A3 elongation size can be fed from the medium feeding unit 14, the medium with A4 size can be fed from the medium storage cassette 22.

As illustrated in FIG. 8, the power transmission unit cover 68 which covers the power transmission unit 62 is disposed on an inside of a medium transport region in the medium feeding unit 14 in the apparatus width direction, that is, inside the space 66. In addition, as illustrated in FIG. 6, at least a part of the power transmission unit 62 and the power transmission unit cover 68 are disposed on the rear surface side of the first guide unit 52 of the medium feeding unit 14 in the apparatus depth direction. Therefore, as illustrated in FIGS. 6 to 8, when straight drawing the medium feeding unit 14 to the rear surface side in the apparatus depth direction, the first guide unit 52 has a position relationship at which the first guide unit 52 interferes with the power transmission unit 62 and the power transmission unit cover 68.

Second Guide Unit

Next, a second guide unit 70 will be described with reference to FIGS. 3, 5, and 6. The second guide unit 70 is provided on the upstream side of the recording head 36 in the transport direction in the apparatus main body 12. A second guide surface 70*a* is formed in the downward slope from the rear surface side to the front side in the apparatus depth direction, on a lower surface of the second guide unit 70. A part on the upstream side of the second guide surface 70*a* is positioned on an upper side of the first guide surface 52*a* of the first guide unit 52 in the apparatus height direction and is opposite to the first guide surface 52*a*.

One end of a load applying unit 72 is attached to a part on the upstream side of the second guide unit 70 in the medium transport direction. The other end of the load applying unit 72 is attached to the apparatus main body 12. In the present embodiment, as an example, the load applying unit 72 is configured as a spring member. The transport following roller 34*b* is rotatably attached to a part on the downstream side of the second guide unit 70 in the medium transport direction. The second guide unit 70 can be swung around the apparatus main body 12 by a rotary shaft (not illustrated). When a load of the load applying unit 72 is applied, the transport following roller 34*b* pushes the transport driving roller 34*a*.

In the present embodiment, the part on the upstream side of the second guide surface 70*a* of the second guide unit 70 and the first guide surface 52*a* of the first guide unit 52 are overlapped with each other in the apparatus height direction and in the apparatus depth direction. Specifically, as illustrated in FIG. 22, the part on the upstream side of the second guide surface 70*a* of the second guide unit 70 and the first guide surface 52*a* of the first guide unit 52 are overlapped with each other in a region A in the apparatus height direction. Further, as illustrated in FIG. 22, the part on the upstream side of the second guide surface 70*a* of the second guide unit 70 and the first guide surface 52*a* of the first guide unit 52 are overlapped with each other in a region B in the apparatus depth direction. Therefore, in the present embodiment, when straight drawing the medium feeding unit 14 to the upper side in the apparatus height direction, the first guide unit 52 has a position relationship (region B in FIG. 22) at which the first guide unit 52 interferes with the second guide unit 70.

Detachment of Medium Feeding Unit

Next, detachment of the medium feeding unit 14 from the apparatus main body 12 will be described with reference to FIGS. 4, 5, and 9 to 12. FIGS. 4, 9, and 10, two fixing units 14*a* are respectively formed in end portions of the medium feeding unit 14 in the apparatus width direction (X axis direction) as an example. The fixing unit 14*a* is accessible from the upper side in the apparatus height direction in a state in which the medium feeding unit 14 is mounted on the apparatus main body 12.

In the present embodiment, as illustrated in FIGS. 9 and 10, four fastening members 74 are respectively attached to the four fixing units 14*a*. By fastening the fastening member 74, the medium feeding unit 14 is fixed to the apparatus main body 12. In the present embodiment, as an example, the fastening member 74 is configured as a screw, a bolt, or the like.

In the present embodiment, by loosening the fastening member 74, the fastening member 74 is separated from the fixing unit 14*a*, so that a fixed state between the apparatus main body 12 and the medium feeding unit 14 is released. Next, as illustrated in FIG. 5, in the present embodiment, in a state in which the medium feeding unit 14 is mounted on the apparatus main body 12, the first guide unit 52 is positioned between the second guide unit 70 and the medium reversing unit 16 in the apparatus depth direction. In the present embodiment, between the second guide unit 70 and the medium reversing unit 16 in the apparatus depth direction, a space 76 (FIGS. 11 and 12) for drawing the first guide unit 52 toward the rear surface side of the apparatus in the diagonally upward direction is formed.

As illustrated in FIGS. 11 and 12, in a state in which the fastening member 74 is separated from the fixing unit 14*a*, when lifting the medium feeding unit 14 toward the rear surface side of the apparatus in the diagonally upward direction, the first guide unit 52 is moved from the lower side to the rear surface side of the second guide unit 70 in the apparatus depth direction. At the same time, since the first guide unit 52 is displaced to the upper side in the apparatus height direction, the first guide unit 52 does not interfere with the second guide unit 70 when drawing the medium feeding unit 14. Further, by displacing the first guide unit 52 in the diagonally upward direction from or to the power transmission unit 62 and the power transmission unit cover 68 inside the space 66 on the rear surface side of the first guide unit 52 in the apparatus depth direction, it is possible to avoid interference.

Therefore, by displacing the medium feeding unit 14 in the state in FIG. 5 from or to the apparatus main body 12 toward the rear surface side of the apparatus in the diagonally upward direction, as illustrated in FIG. 12, it is possible to draw the medium feeding unit 14 from the apparatus main body 12. In the present embodiment, as illustrated in FIGS. 11 and 12, since the medium feeding unit 14 is detached in a state in which the medium reversing unit 16 is mounted on the apparatus main body 12, it is possible to improve workability when detaching the medium feeding unit 14. Further, since the power transmission unit 62 and the second guide unit 70 do not interfere with each other when the medium feeding unit 14 is attached and detached to and from the apparatus main body 12 and the medium feeding unit 14 can be mounted on the apparatus main body 12 regardless of the state in which the medium reversing unit 16 is mounted on the apparatus main body 12, it is possible to improve workability in an assembling process of the printer 10.

Detachment of Medium Reversing Unit

Next, detachment of the medium reversing unit 16 from the apparatus main body 12 will be described with reference to FIGS. 3, 6, and 13 to 16. In a case where the medium reversing unit 16 is attached to the apparatus main body 12 from a state in which the medium reversing unit 16 is separated from the apparatus main body 12 as illustrated in FIG. 6, the medium reversing unit 16 approaches the rear surface side of the apparatus main body 12 as illustrated in FIG. 13. At this time, in some cases, the rear feeding port cover 24 of the medium reversing unit 16 contacts with the edge guide 54 of the medium feeding unit 14.

In FIG. 14, R shapes are formed in both of the front side and the rear surface side of a tip portion 24*a* of the rear feeding port cover 24 in the apparatus depth direction. A rear surface side end portion 54*b* of the edge guide 54 in the apparatus depth direction is formed in the downward slope from the front side toward the rear surface side in the apparatus depth direction.

As illustrated in FIG. 14, when pushing the medium reversing unit 16 in a side of the apparatus main body 12 in a state in which the tip portion 24*a* of the rear feeding port cover 24 contacts with the rear surface side end portion 54*b* of the edge guide 54, as illustrated in FIG. 16, the rear feeding port cover 24 rotates around the medium reversing unit 16 toward the upper side in the apparatus height direction. At this time, the tip portion 24*a* of the rear feeding port cover 24 is displaced on the upper side in the apparatus height direction along the rear surface side end portion 54*b* of the edge guide 54 and rides the upper surface of the edge guide 54 (see FIG. 16).

Here, as illustrated in FIGS. 15 and 16, a front side portion 54*c* of the edge guide 54 in the apparatus depth direction is formed in the downward slope from the rear surface side to the front side in the apparatus depth direction. When further pushing the medium reversing unit 16 in the side of the apparatus main body 12 from the state illustrated in FIG. 16, the tip portion 24*a* of the rear feeding port cover 24 is displaced in the lower direction along the downward slope of the front side portion 54*c* of the edge guide 54. Accordingly, the rear feeding port cover 24 also rotates to the lower direction side in the apparatus height direction. As a result, as illustrated in FIG. 3, the rear feeding port cover 24 is positioned at the upper direction side of the feeding port 44 of the medium feeding unit 14 in a state in which the medium reversing unit 16 is mounted on the apparatus main body 12 and covers the feeding port 44.

In the present embodiment, since the R shape is provided in the tip portion 24*a* of the rear feeding port cover 24 and the rear surface side end portion 54*b* of the edge guide 54 is provided as a slope, even if the rear feeding port cover 24 of the medium reversing unit 16 contacts with the edge guide 54 of the medium feeding unit 14, it is possible to smoothly mount the medium reversing unit 16 on the apparatus main body 12 without a user opening the rear feeding port cover 24.

Medium Storage Cassette

Next, the medium storage cassette 22 will be described with reference to FIGS. 17 to 19. As illustrated in FIG. 17, the medium storage cassette 22 includes a bottom surface 22*a* and a side wall portion 22*b* extended toward the upper side in the apparatus height direction at each of end portions in the apparatus width direction. In the medium storage cassette 22, a rear end edge guide 22*c* is provided at an end portion on the front side in the apparatus depth direction.

The rear end edge guide 22*c* is configured to be capable of switching between an upright posture to the bottom surface 22*a* and a fallen posture to the bottom surface 22*a*. Specifically, the rear end edge guide 22*c* is configured to be attached to the bottom surface 22*a* via a rotary shaft (not illustrated) and to be capable of rotating around the bottom surface 22*a*.

As illustrated in FIGS. 17 and 18, when the rear end edge guide 22*c* stands upright to the bottom surface 22*a* of the medium storage cassette 22, the rear end edge guide 22*c* defines a position of the rear end of the medium stored in the medium storage cassette 22 in the transport direction. In the state in which the rear end edge guide 22*c* stands upright, the rear end edge guide 22*c* defines the position of the rear end of the medium with a standard size, for example, A4 size in the present embodiment.

On the other hand, as illustrated in FIG. 19, when the rear end edge guide 22*c* falls to the bottom surface 22*a* of the medium storage cassette 22, the rear end edge guide 22*c* does not define the position of the rear end of the medium stored in the medium storage cassette 22 in the transport direction. Specifically, it is possible to store the medium stored in the medium storage cassette 22 in a state in which the rear end of the medium protrudes from the end portion on the front side of the medium storage cassette 22 in the apparatus depth direction. As a result, the medium storage cassette 22 can store not only the medium with a standard size (A4 size in present embodiment) but also the medium further longer in the medium transport direction. Accordingly, the printer 10 also can perform recording on the medium longer in the medium transport direction.

Scale

As illustrated in FIG. 21, a scale cover 78 is provided at a position opposite to the feeding port 44 on an upper surface 12*a* of the apparatus main body 12. In the present embodiment, in the scale cover 78, for example, two rows of gradation portions 78*a* and 78*b* are formed along the X axis direction. For example, the gradation portion 78*a* is configured to be displayed in millimeters and the gradation portion 78*b* is configured to be displayed in inches.

Further, by display a size or the like (for example, A3+ or 13 (see FIG. 15)) of the medium on both ends of the gradation portions 78*a* and 78*b*, it is possible to check the size of the medium settable to the medium supporting unit 46. In the present embodiment, by displaying the size of the medium with A3+, it is possible for the user to recognize that the size of the medium which can be transported in the printer 10 according to the present embodiment is A3 size as well as A4 size as an example.

In the present embodiment, when the medium is set to the medium supporting unit 46 of the medium feeding unit 14, with reference to the gradation portions 78*a* and 78*b*, it is possible to easily set the position of the medium in the medium supporting unit 46, that is, a position of the edge guide 54.

In the present embodiment, the gradation portions 78*a* and 78*b* are formed on the scale cover 78. Instead of this configuration, the gradation portions 78*a* and 78*b* may be printed on the scale cover 78, or a seal on which the gradation portions 78*a* and 78*b* are printed may be attached to the scale cover 78. In the present embodiment, the gradation portion is displayed in millimeters and in inches, but only one of millimeters and inches may be displayed.

Modification Example of Embodiment

The driving motor (not illustrated) in the present embodiment may rotatably drive not only the reversing roller 32 but also the transport driving roller 34*a* and the pair of discharge driving rollers 38*a*.

To summarize the description, the printer 10 includes the recording head 36 which performs recording on the medium transported in the +Y direction as the first direction and the medium supporting unit 46 which is positioned in the −Y direction, as the second direction opposite to the +Y direction as the first direction, of the recording head 36 and is formed in the downward slope in the +Y direction as the first direction. In addition, the printer 10 includes the medium feeding unit 14 which transmits the supported medium to the +Y direction side as the first direction and the medium reversing unit 16 which is positioned in the −Y direction, as the second direction, of the medium supporting unit 46, reverses the medium transmitted in the −Y direction as the second direction after the recording of the recording head 36, and transmits the medium to the +Y direction side as the first direction. The medium feeding unit 14 includes the first guide unit 52 which is positioned on the downstream side of the medium supporting unit 46 and forms the first guide surface 52*a* in the downward slope in the +Y direction as the first direction. The apparatus main body 12 including the recording head 36 and the medium reversing unit 16 includes the power transmission unit 62 which transmits a driving power from the driving motor which is a power source of the medium reversing unit 16 to the medium reversing unit 16. At least a part of the first guide unit 52 in the apparatus height direction overlaps with the power transmission unit 62.

According to this configuration, since at least a part of the first guide unit 52 included in the medium feeding unit 14 overlaps with the power transmission unit 62 in the apparatus height direction, the medium feeding unit 14 is disposed at a position lowered to the same height position as at least a part of the power transmission unit 62 in the apparatus height direction. Therefore, by disposing the medium feeding unit 14 at a lower position in the apparatus height direction, it is possible to suppress a dimension in the apparatus height direction and to further miniaturize the printer 10.

The power transmission unit 62 is disposed in the space 66 formed on the −Y direction side as the second direction of the medium supporting unit 46. According to this configuration, it is possible to suppress the dimension of the apparatus in the apparatus depth direction (Y direction) and the dimension of the apparatus in the medium width direction (X direction) which intersects with the medium feeding direction.

The apparatus main body 12 includes the second guide unit 70 which forms the downward slope in the +Y direction as the first direction and forms the second guide surface 70*a* positioned on the upper side of the first guide surface 52*a*. At least a part of the first guide unit 52 in the apparatus height direction overlaps with the second guide unit 70. According to this configuration, since the medium feeding unit 14 is disposed at a position lowered to the same height position as at least a part of the second guide unit 70 in the apparatus height direction, it is possible to suppress the dimension in the apparatus height direction and to further miniaturize the printer 10.

The apparatus main body 12 includes the second guide unit 70 which forms the downward slope in the +Y direction as the first direction and forms the second guide surface 70*a* positioned on the upper side of the first guide surface 52*a*. At least a part of the first guide unit 52 overlaps with the second guide unit 70 in the apparatus depth direction including the +Y direction as the first direction and the −Y direction as the second direction. According to this configuration, it is possible to suppress the dimension in the apparatus depth direction and to further miniaturize the printer 10.

The first guide unit 52 is positioned between the second guide unit 70 and the medium reversing unit 16 and the space 76 for drawing the first guide unit 52 toward the −Y direction as the second direction in the diagonally upward direction is formed between the second guide unit 70 and the medium reversing unit 16, in the apparatus depth direction (Y axis direction) including the +Y direction as the first direction and the −Y direction as the second direction. The medium feeding unit 14 can be attached to or detached from the apparatus main body 12. According to this configuration, it is possible to easily attach or detach the medium feeding unit 14 to or from the apparatus main body 12 with improved workability.

The power transmission unit 62 includes the plurality of gears 64A, 64B, 64C, 64D, 64E, 64F, 64G, and 64H and the plurality of gears 64A, 64B, 64C, 64D, 64E, 64F, 64G, and 64H are arranged along the drawing direction of the first guide unit 52.

The printer 10 includes the recording head 36 which performs recording on the medium transported in the +Y direction as the first direction and the medium supporting unit 46 which is positioned in the −Y direction, as the second direction opposite to the +Y direction as the first direction, of the recording head 36 and is formed in the downward slope in the +Y direction as the first direction. In addition, the printer 10 includes the medium feeding unit 14 which transmits the supported medium to the +Y direction side as the first direction and the medium reversing unit 16 which is positioned in the −Y direction, as the second direction, of the medium supporting unit 46, reverses the medium transmitted in the −Y direction as the second direction after the recording of the recording head 36, and transmits the medium to the +Y direction side as the first direction. The medium feeding unit 14 includes the first guide unit 52 which is positioned on the downstream side of the medium supporting unit 46 and forms the first guide surface 52*a* in the downward slope in the +Y direction as the first direction. The apparatus main body 12 including the recording head 36 and the medium reversing unit 16 includes the second guide unit 70 which forms in the downward slope the +Y direction as the first direction and forms the second guide surface 70*a* positioned on the upper side of the first guide surface 52*a*. The first guide unit 52 is positioned between the medium reversing unit 16 and the second guide unit 70 in the apparatus depth direction (Y axis direction) including the +Y direction as the first direction and the −Y direction as the second direction and at least a part of the first guide unit 52 in the apparatus height direction overlaps with the second guide unit 70.

According to this configuration, since at least a part of the first guide unit 52 overlaps with the second guide unit 70 in the apparatus height direction, the medium feeding unit 14 is disposed at a position lowered to the same height position as at least a part of the second guide unit 70 in the apparatus height direction. Therefore, by disposing the medium feeding unit 14 at a lower position in the vertical direction, it is possible to suppress the dimension in the apparatus height direction and to further miniaturize the printer 10.

At least a part of the first guide unit 52 overlaps with the second guide unit 70 in the apparatus depth direction. According to this configuration, it is possible to suppress the dimension in the apparatus depth direction and to further miniaturize the printer 10.

The space 76 for drawing the first guide unit 52 toward the −Y direction as the second direction in the diagonally upward direction is formed between the second guide unit 70 and the medium reversing unit 16 and the medium feeding unit 14 can be attached to or detached from the apparatus main body 12. According to this configuration, it is possible to easily attach or detach the medium feeding unit 14 to or from the apparatus main body 12 with improved workability.

The medium feeding unit 14 is fixed to the apparatus main body 12 by the fastening member 74 accessible from the upper direction side in the apparatus height direction. According to this configuration, it is possible to easily fix or release the medium feeding unit 14 to or from the apparatus main body 12 with improved workability.

Further, in the present embodiment, the medium feeding unit 14 according to the invention is applied to an ink jet printer as an example of the recording apparatus, but the medium feeding unit 14 also may be applied to another liquid ejecting apparatus.

Here, as the liquid ejecting apparatus, an ink jet recording head is used. The liquid ejecting apparatus is not limited to a printer which causes the recording head to eject ink and performs recording on the medium to be recorded and a recording apparatus such as a copying machine, a facsimile machine, or the like. The liquid ejecting apparatus may include an apparatus which attaches liquid corresponding to use of the ink instead of the ink to a medium to be ejected by causing a liquid ejecting head corresponding to the ink jet recording head to eject the liquid on the medium to be ejected corresponding to the medium to be recorded.

As the liquid ejecting head, in addition to the recording head, a color material ejecting head used for manufacturing a color filter such as a liquid crystal display, an electrode material (conductive paste) ejecting head used for electrode formation of an organic EL display, a field emitting display (FED), a bioorganic material ejecting head used for manufacturing biochip, and a sample ejecting head as precision pipette, and the like are used.

The invention is not limited the embodiments described above. Various modifications are possible within the scope of the invention and the various modifications are also included in the scope of the invention.

The entire disclosure of Japanese Patent Application No. 2017-136023, filed Jul. 12, 2017 is expressly incorporated by reference herein.

What is claimed is:

1. A recording apparatus comprising:

a recording unit that performs recording on a medium being transported in a first direction;

a medium feeding unit that is positioned in a second direction opposite to the first direction of the recording unit, includes a medium supporting unit, and transmits the supported medium to a side of the first direction; and a medium reversing unit that reverses the medium being transmitted in the second direction after the recording of the recording unit, and transmits the medium to the side of the first direction, wherein the medium feeding unit includes a first guide unit that is positioned on a side of the second direction of the medium supporting unit and forms a first guide surface in the downward slope toward the first direction, and a power transmission unit that transmits a driving power from a power source of the medium reversing unit to the medium reversing unit, and at least a part of the first guide unit in a vertical direction overlaps with the power transmission unit.

2. The recording apparatus according to claim 1, wherein the power transmission unit is disposed in a space formed on the side of the second direction of the medium supporting unit.

3. The recording apparatus according to claim 1, further comprising:

a second guide unit which forms a second guide surface in the downward slope in the first direction and positioned on an upper side of the first guide surface, and at least a part of the first guide unit in the vertical direction overlaps with the second guide unit.

4. The recording apparatus according to claim 1, further comprising:

a second guide unit which forms a second guide surface in the downward slope in the first direction and positioned on an upper side of the first guide surface, and at least a part of the first guide unit in an apparatus depth direction including the first direction and the second direction overlaps with the second guide unit.

5. The recording apparatus according to claim 3, wherein the first guide unit is positioned between the second guide unit and the medium reversing unit in an apparatus depth direction including the first direction and the second direction, and a space for drawing the first guide unit toward the second direction in the diagonally upward direction is formed between the second guide unit and the medium reversing unit and the medium feeding unit is detachable from the apparatus main body.

6. The recording apparatus according to claim 5, wherein the power transmission unit includes a plurality of gears, and the plurality of gears are arranged along a drawing direction of the first guide unit.

7. The recording apparatus according to claim 1, wherein the medium feeding unit is fixed to an apparatus main body by a fastening member accessible in a vertical direction.

8. A recording apparatus comprising:

a recording unit that performs recording on a medium being transported in a first direction;

a medium feeding unit that is positioned in a second direction opposite to the first direction of the recording unit, includes a medium supporting unit which forms a downward slope in the first direction, and transmits the supported medium to a side of the first direction; and a medium reversing unit that is positioned in the second direction of the medium supporting unit, reverses the medium being transmitted in the second direction after the recording of the recording unit, and transmits the medium to the side of the first direction, wherein the medium feeding unit includes a first guide unit that is positioned on a downstream side of the medium supporting unit and forms a first guide surface in the downward slope toward the first direction, an apparatus main body including the recording unit and the medium reversing unit includes a second guide unit which forms the second guide surface in downward slope in the first direction and the positioned on an upper side of the first guide surface, and the first guide unit is positioned between the medium reversing unit and the second guide unit in an apparatus depth direction including the first direction and the second direction and at least a part of the first guide unit in a vertical direction overlaps with the second guide unit.

9. The recording apparatus according to claim 8, wherein at least a part of the first guide unit in the apparatus depth direction overlaps with the second guide unit.

10. The recording apparatus according to claim 8, wherein a space for drawing the first guide unit toward the second direction in the diagonally upward direction is formed between the second guide unit and the medium reversing unit and the medium feeding unit is detachable from the apparatus main body.

* * * * *